US008640976B2

(12) United States Patent
Micheli

(10) Patent No.: US 8,640,976 B2
(45) Date of Patent: Feb. 4, 2014

(54) SPRAY GUN HAVING MECHANISM FOR INTERNALLY SWIRLING AND BREAKING UP A FLUID

(76) Inventor: Paul R. Micheli, Glen Ellyn, IL (US)

( * ) Notice: Subject to any disclaimer, the term of this patent is extended or adjusted under 35 U.S.C. 154(b) by 1095 days.

(21) Appl. No.: 11/927,559

(22) Filed: Oct. 29, 2007

(65) Prior Publication Data

US 2008/0048055 A1 Feb. 28, 2008

Related U.S. Application Data

(63) Continuation of application No. 10/898,103, filed on Jul. 23, 2004, now Pat. No. 7,311,271, which is a continuation-in-part of application No. 10/223,193, filed on Aug. 19, 2002, now Pat. No. 6,808,122.

(51) Int. Cl.
*B05B 1/34* (2006.01)

(52) U.S. Cl.
USPC ..... 239/463; 239/290; 239/296; 239/487; 239/526

(58) Field of Classification Search
USPC ..... 239/1, 11, 290, 292, 296, 407, 419, 239/422, 424, 424.5, 427–430, 433, 434.5, 239/463, 487–489, 497, 503, 520, 526, 600
See application file for complete search history.

(56) References Cited

U.S. PATENT DOCUMENTS

| | | | | |
|---|---|---|---|---|
| 1,650,128 | A | | 11/1927 | Hubbard |
| 2,307,014 | A | | 11/1928 | Becker et al. |
| 1,741,169 | A | | 12/1929 | Thompson |
| 2,050,368 | A | * | 8/1936 | Neely ..... 239/406 |
| 2,246,211 | A | | 6/1941 | Kilich |
| 2,303,280 | A | | 11/1942 | Jenkins |
| 2,435,605 | A | | 2/1948 | Rowell |
| 2,595,759 | A | | 5/1952 | Buckland et al. |
| 2,895,685 | A | | 7/1959 | Peeps |
| 3,032,277 | A | | 5/1962 | Petty |

(Continued)

FOREIGN PATENT DOCUMENTS

| | | |
|---|---|---|
| EP | 06630690 | 12/1994 |
| EP | 1108476 | 6/2001 |

(Continued)

OTHER PUBLICATIONS

Spanogle et al.; *Development of an Impinging-Jet Fuel-Injection Valve Nozzle*; National Advisory Committee for Aeronautics; Technical Note No. 372, 1931.

*Primary Examiner* — Jason Boeckmann
(74) *Attorney, Agent, or Firm* — Fletcher Yoder, P.C.

(57) ABSTRACT

The present technique provides a system and method for improving atomization in a spray coating device by internally mixing and breaking up a desired coating fluid prior to atomization. In one embodiment, a flow barrier is disposed in the spray coating device downstream of an internal fluid valve and upstream of a fluid exit. The flow barrier may have a plurality of passages configured to direct fluid streams to create a fluid swirling and rotating motion around a central axis of a central flow path to facilitate fluid mixing and breakup. The plurality of passages may direct the fluid streams toward a surface, and may be angled substantially toward one another or diverging from one another. Embodiments of the spray coating device may further include an atomization mechanism adapted to facilitate formation of a spray of the fluid flowing from the fluid exit. The resulting spray coating has refined characteristics, such as reduced mottling.

25 Claims, 13 Drawing Sheets

(56) References Cited

U.S. PATENT DOCUMENTS

| | | | | | |
|---|---|---|---|---|---|
| 3,100,084 | A | | 8/1963 | Biber | |
| 3,130,910 | A | | 4/1964 | Sill | |
| 3,190,564 | A | | 6/1965 | Liedberg | |
| 3,344,558 | A | | 10/1967 | Kirkland | |
| 3,521,824 | A | | 7/1970 | Wilcox | |
| 3,734,406 | A | | 5/1973 | Runstadler et al. | |
| 3,746,253 | A | | 7/1973 | Walberg | |
| 3,747,851 | A | | 7/1973 | Conrad | |
| 3,857,511 | A | | 12/1974 | Govindan | |
| 3,907,202 | A | * | 9/1975 | Binoche | 239/705 |
| 3,946,947 | A | | 3/1976 | Schneider | |
| 4,159,082 | A | | 6/1979 | Luderer et al. | |
| 4,260,110 | A | | 4/1981 | Werding | |
| 4,330,086 | A | | 5/1982 | Nysted | |
| 4,406,407 | A | * | 9/1983 | Aprea et al. | 239/487 |
| 4,485,968 | A | | 12/1984 | Berthiaume | |
| 4,520,962 | A | | 6/1985 | Momono et al. | |
| 4,630,774 | A | * | 12/1986 | Rehman et al. | 239/8 |
| 4,632,314 | A | | 12/1986 | Smith et al. | |
| 4,646,968 | A | | 3/1987 | Sablatura | |
| 4,767,057 | A | | 8/1988 | Degli et al. | |
| 4,899,937 | A | | 2/1990 | Haruch | |
| 4,909,443 | A | | 3/1990 | Takagi | |
| 4,998,672 | A | | 3/1991 | Bordaz et al. | |
| 5,035,358 | A | | 7/1991 | Katsuno et al. | |
| 5,067,655 | A | * | 11/1991 | Farago et al. | 239/124 |
| 5,072,883 | A | | 12/1991 | Vidusek | |
| 5,074,466 | A | | 12/1991 | Santiago | |
| 5,106,025 | A | | 4/1992 | Giroux et al. | |
| 5,170,941 | A | | 12/1992 | Morita et al. | |
| 5,180,104 | A | | 1/1993 | Mellette | |
| 5,209,405 | A | | 5/1993 | Robinson et al. | |
| 5,249,746 | A | | 10/1993 | Kaneko et al. | |
| 5,273,059 | A | | 12/1993 | Gross et al. | |
| 5,319,568 | A | | 6/1994 | Bezaire | |
| 5,344,078 | A | | 9/1994 | Fritz et al. | |
| 5,358,182 | A | | 10/1994 | Cappeau et al. | |
| 5,419,491 | A | | 5/1995 | Breitsprecher | |
| 5,429,491 | A | | 7/1995 | Gellert | |
| 5,553,784 | A | | 9/1996 | Theurer | |
| 5,685,482 | A | | 11/1997 | Sickles | |
| 5,685,495 | A | | 11/1997 | Pham et al. | |
| 5,699,967 | A | | 12/1997 | Conatser et al. | |
| 5,899,387 | A | | 5/1999 | Haruch | |
| 6,021,962 | A | | 2/2000 | Hedger | |
| 6,045,057 | A | | 4/2000 | Moor et al. | |
| 6,085,996 | A | | 7/2000 | Culbertson et al. | |
| 6,129,295 | A | | 10/2000 | Johansson | |
| 6,142,388 | A | | 11/2000 | Schwab | |
| 6,152,388 | A | | 11/2000 | Rohloff | |
| 6,161,778 | A | | 12/2000 | Haruch | |
| 6,186,273 | B1 | | 2/2001 | Goldbach et al. | |
| 6,189,214 | B1 | | 2/2001 | Skeath et al. | |
| 6,289,676 | B1 | | 9/2001 | Prociw et al. | |
| 6,450,422 | B1 | | 9/2002 | Maggio | |
| 6,592,054 | B2 | | 7/2003 | Prus | |
| 6,659,367 | B2 | | 12/2003 | Ballu | |
| 6,669,112 | B2 | | 12/2003 | Reetz, III et al. | |
| 6,669,115 | B2 | | 12/2003 | Sun et al. | |
| 6,776,360 | B2 | | 8/2004 | Haruch et al. | |
| 6,808,122 | B2 | | 10/2004 | Mitcheli | |
| 7,028,916 | B2 | | 4/2006 | Micheli | |
| 2002/0195505 | A1 | | 12/2002 | Haruch et al. | |
| 2003/0066905 | A1 | | 4/2003 | Huffman | |
| 2003/0164406 | A1 | | 9/2003 | Ballu | |
| 2004/0031860 | A1 | | 2/2004 | Micheli | |
| 2004/0046040 | A1 | | 3/2004 | Micheli | |
| 2006/0000928 | A1 | | 1/2006 | Micheli | |
| 2006/0214027 | A1 | | 9/2006 | Micheli | |

FOREIGN PATENT DOCUMENTS

| | | |
|---|---|---|
| EP | 1391246 | 7/2003 |
| EP | 1611958 | 1/2006 |
| JP | 463384 | 10/1971 |
| JP | 51000011 | 1/1976 |
| JP | 63319076 | 12/1988 |
| JP | 9094494 | 4/1999 |
| JP | 2001017893 | 1/2001 |
| TW | 200510069 | 3/2005 |
| WO | WO9407607 | 4/1994 |
| WO | WO0000770 | 1/2000 |
| WO | WO0102099 | 1/2001 |

* cited by examiner 226
204
8
6
266
288
284
298
322
308
312,314
9A,9B
274
320
316
234
282
328
324
318
280
286
326
290
216
276
296
278
9A,9B
302,304
316
294
322
310
306
300
320
292
268
270
272
8
6

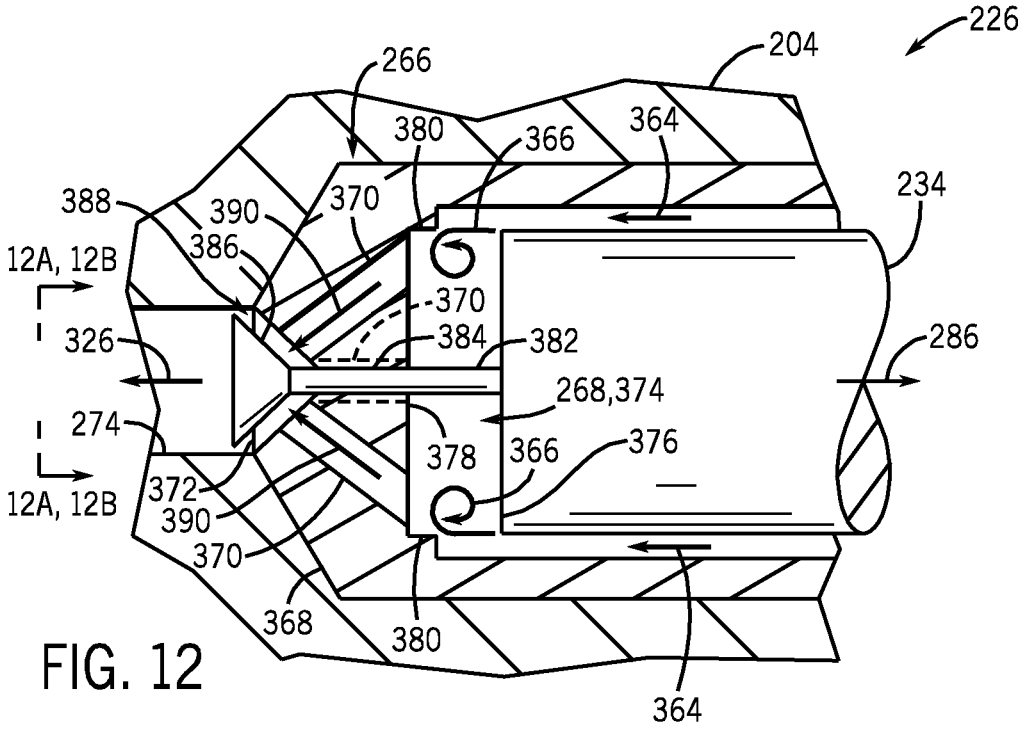
FIG. 12
FIG. 12A
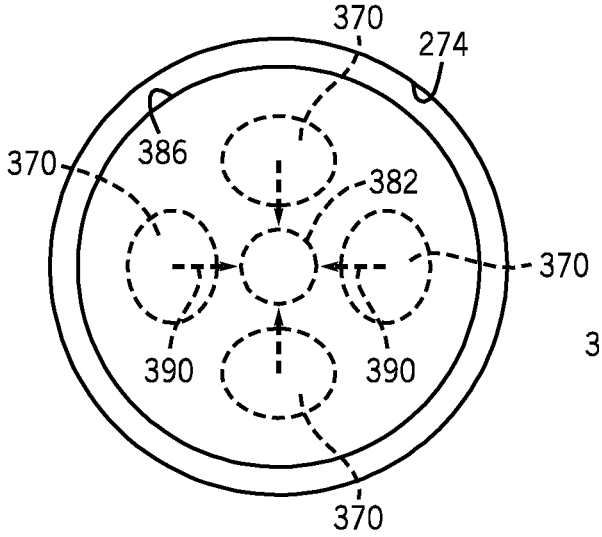
FIG. 12B
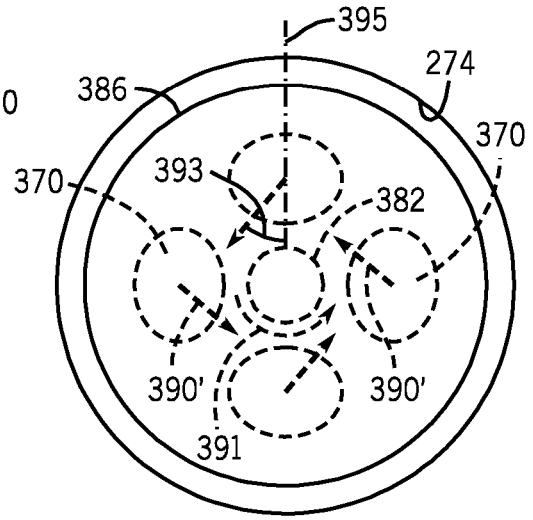

SPRAY GUN HAVING MECHANISM FOR INTERNALLY SWIRLING AND BREAKING UP A FLUID

CROSS REFERENCE TO RELATED APPLICATIONS

This is a continuation of copending application Ser. No. 10/898,103, filed on Jul. 23, 2004, which is a continuation-in-part of application Ser. No. 10/223,193 filed on Aug. 19, 2002, now U.S. Pat. No. 6,808,122, each of which is hereby incorporated by reference.

BACKGROUND OF THE INVENTION

The present technique relates generally to spray systems and, more particularly, to industrial spray coating systems. The present technique specifically provides a system and method for improving atomization in a spray coating device by internally mixing and breaking up the fluid prior to atomization at a spray formation section of the spray coating device.

Spray coating devices are used to apply a spray coating to a wide variety of produce types and materials, such as wood and metal. The spray coating fluids used for each different industrial application may have much different fluid characteristics and desired coating properties. For example, wood coating fluids/stains are generally viscous fluids, which may have significant particulate/ligaments throughout the fluid/stain. Existing spray coating devices, such as air atomizing spray guns, are often unable to breakup the foregoing particulate/ligaments. The resulting spray coating has an undesirably inconsistent appearance, which may be characterized by mottling and various other inconsistencies in textures, colors, and overall appearance. In air atomizing spray guns operating at relatively low air pressures, such as below 10 psi, the foregoing coating inconsistencies are particularly apparent.

Accordingly, a technique is needed for mixing and breaking up a desired coating fluid prior to atomization in a spray formation section of a spray coating device.

SUMMARY OF THE INVENTION

The present technique provides a system and method for improving atomization in a spray coating device by internally mixing and breaking up a desired coating fluid prior to atomization at a spray formation section of the spray coating device. In one embodiment, an internal fluid breakup section has a mixture-inducing valve disposed adjacent a flow barrier upstream of a spray formation exit. The flow barrier may have a plurality of converging and/or diverging conduits that direct fluid streams to a region downstream of the flow barrier at an angle defined with respect to an axis perpendicular to a central flow path of the internal fluid breakup section. This angle may be adjusted to generate rotating or swirling motions of the fluid downstream of the barrier around a central axis to facilitate fluid mixing and breakup prior to atomization and/or formation of the spray. To further facilitate fluid mixing and breakup, the fluid streams may impinge a surface or one another. The resulting spray coating has refined characteristics, such as reduced mottling.

BRIEF DESCRIPTION OF THE DRAWINGS

The foregoing and other advantages and features of the invention will become apparent upon reading the following detailed description and upon reference to the drawings in which:

FIG. 12 is a partial cross-sectional side view of a further alternative embodiment of the fluid delivery tip assembly of FIG. 4 having a modified fluid valve extending through the fluid mixing and breakup sections;

FIG. 12A is a partial cross-sectional face view of the fluid delivery tip assembly of FIG. 12 illustrating jets oriented for surface impingement in a conical cavity section in accordance with embodiments of the present technique;

FIG. 12B is a partial cross-sectional face view of the fluid delivery tip assembly of FIG. 12 illustrating jets oriented for surface impingement and fluid swirl around a central axis in a conical cavity section in accordance with other embodiments of the present technique;

DETAILED DESCRIPTION OF SPECIFIC EMBODIMENTS

As discussed in detail below, the present technique provides a refined spray for coating and other spray applications by internally mixing and breaking up the fluid within the spray coating device. This internal mixing and breakup is achieved by passing the fluid through one or more varying geometry passages, which may comprises sharp turns, abrupt expansions or contractions, or other mixture-inducing flow paths. For example, the present technique may flow the fluid through or around a modified needle valve, which has one or more blunt or angled edges, internal flow passages, and varying geometry structures. Moreover, the present technique may provide a flow barrier, such as a blockade in the fluid passage, having one or more restricted passages extending therethrough to facilitate fluid mixing and particulate breakup. For example, the flow barrier may induce fluid mixing in a mixing cavity between the flow barrier and the modified needle valve. The flow barrier also may create fluid jets from the one or more restricted passages, such that particulate/ligaments in the fluid flow breaks up as the fluid jets impinge against a surface or impinge against one another. The present technique also may optimize the internal mixing and breakup for a particular fluid and spray application by varying the impingement angles and velocities of the fluid jets, varying the flow passage geometries, modifying the needle valve structure, and varying the spray formation mechanism for producing a spray.

Figure 1:
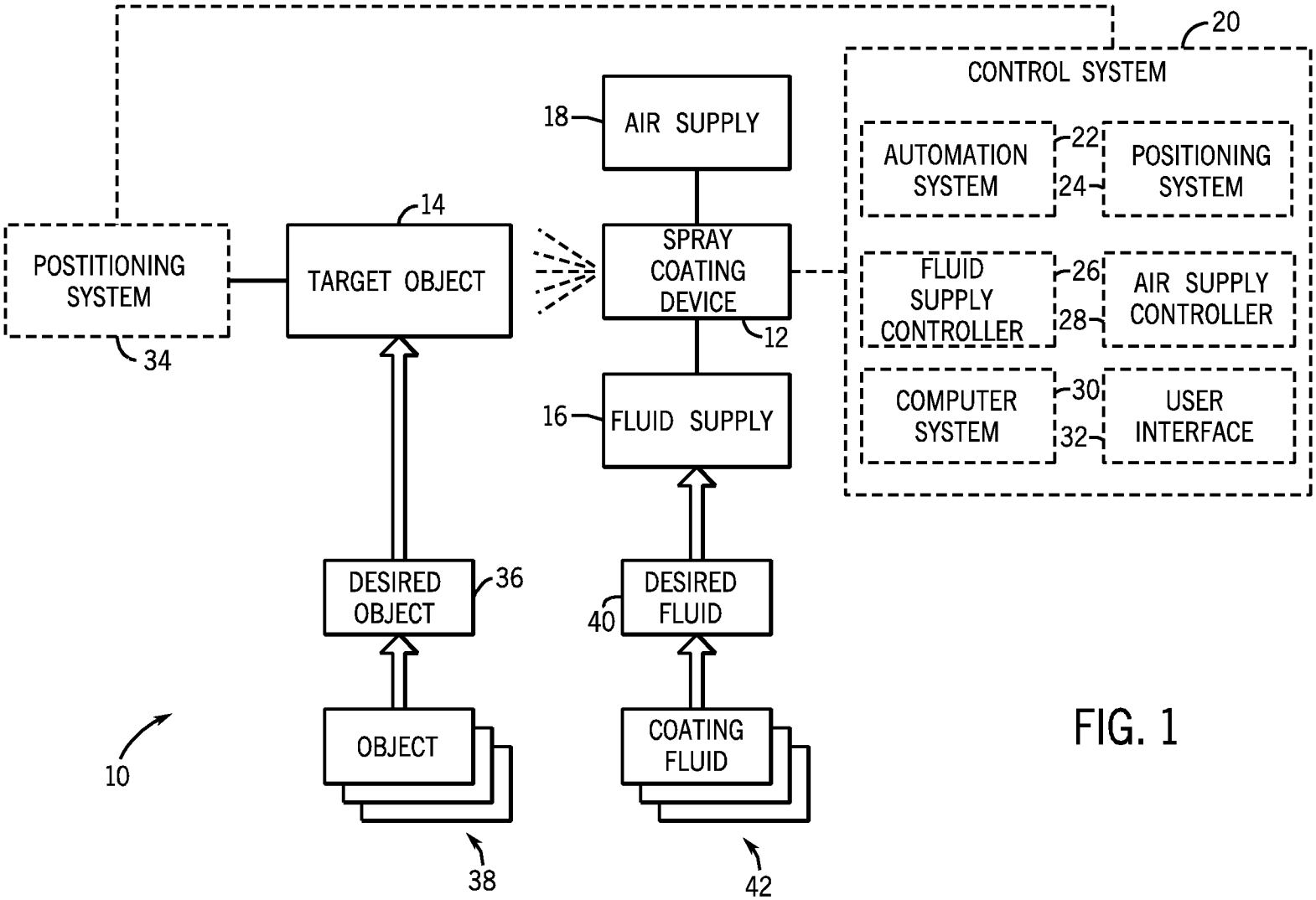
FIG. 1 is a diagram illustrating an exemplary spray coating system of the present technique.

FIG. 1 is a flow chart illustrating an exemplary spray coating system 10, which comprises a spray coating device 12 for applying a desired coating to a target object 14. The spray coating device 12 may be coupled to a variety of supply and control systems, such as a fluid supply 16, an air supply 18, and a control system 20. The control system 20 facilitates control of the fluid and air supplies 16 and 18 and ensures that the spray coating device 12 provides an acceptable quality spray coating on the target object 14. For example, the control system 20 may include an automation system 22, a positioning system 24, a fluid supply controller 26, an air supply controller 28, a computer system 30, and a user interface 32. The control system 20 also may be coupled to a positioning system 34, which facilitates movement of the target object 14 relative to the spray coating device 12. According, the spray coating system 10 may provide a computer-controlled mixture of coating fluid, fluid and air flow rates, and spray pattern. Moreover, the positioning system 34 may include a robotic arm controlled by the control system 20, such that the spray coating device 12 covers the entire surface of the target object 14 in a uniform and efficient manner.

The spray coating system 10 of FIG. 1 is applicable to a wide variety of applications, fluids, target objects, and types/configurations of the spray coating device 12. For example, a user may select a desired fluid 40 from a plurality of different coating fluids 42, which may include different coating types, colors, textures, and characteristics for a variety of materials such as metal and wood. The user also may select a desired object 36 from a variety of different objects 38, such as different material and product types. As discussed in further detail below, the spray coating device 12 also may comprise a variety of different components and spray formation mechanisms to accommodate the target object 14 and fluid supply 16 selected by the user. For example, the spray coating device 12 may comprise an air atomizer, a rotary atomizer, an electrostatic atomizer, or any other suitable spray formation mechanism.

Figure 2:
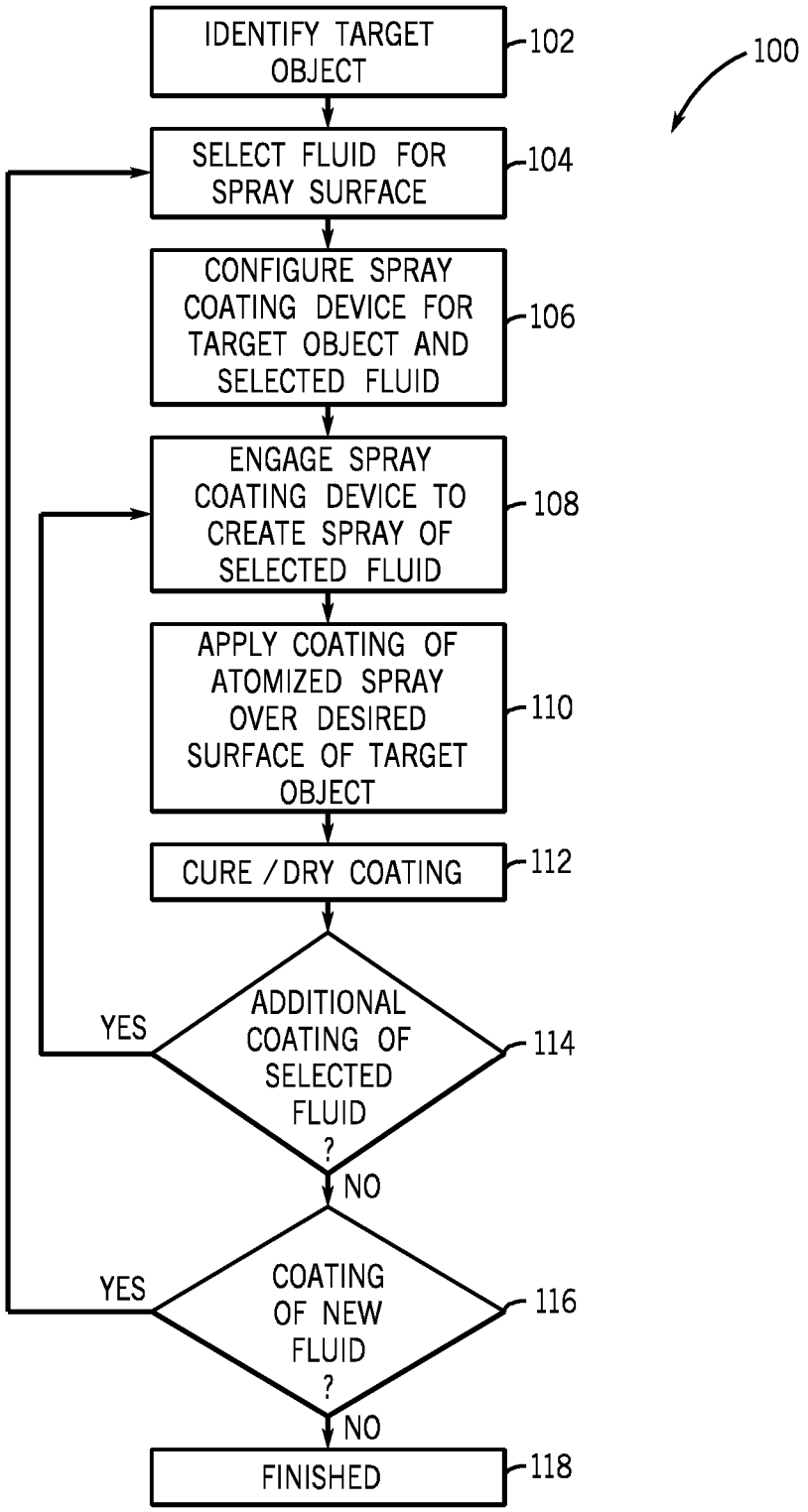
FIG. 2 is a flow chart illustrating an exemplary spray coating process of the present technique.

FIG. 2 is a flow chart of an exemplary spray coating process 100 for applying a desired spray coating to the target object 14. As illustrated, the process 100 proceeds by identifying the target object 14 for application of the desired fluid (block 102). The process 100 then proceeds by selecting the desired fluid 40 for application to a spray surface of the target object 14 (block 104). A user may then proceed to configure the spray coating device 12 for the identified target object 14 and selected fluid 40 (block 106). As the user engages the spray coating device 12, the process 100 then proceeds to create an atomized spray of the selected fluid 40 (block 108). The user may then apply a coating of the atomized spray over the desired surface of the target object 14 (block 110). The process 100 then proceeds to cure/dry the coating applied over the desired surface (block 112). If an additional coating of the selected fluid 40 is desired by the user at query block 114, then the process 100 proceeds through blocks 108, 110, and 112 to provide another coating of the selected fluid 40. If the user does not desire an additional coating of the selected fluid at query block 114, then the process 100 proceeds to query block 116 to determine whether a coating of a new fluid is desired by the user. If the user desires a coating of a new fluid at query block 116, then the process 100 proceeds through blocks 104-114 using a new selected fluid for the spray coating. If the user does not desire a coating of a new fluid at query block 116, then the process 100 is finished at block 118.

Figure 3:
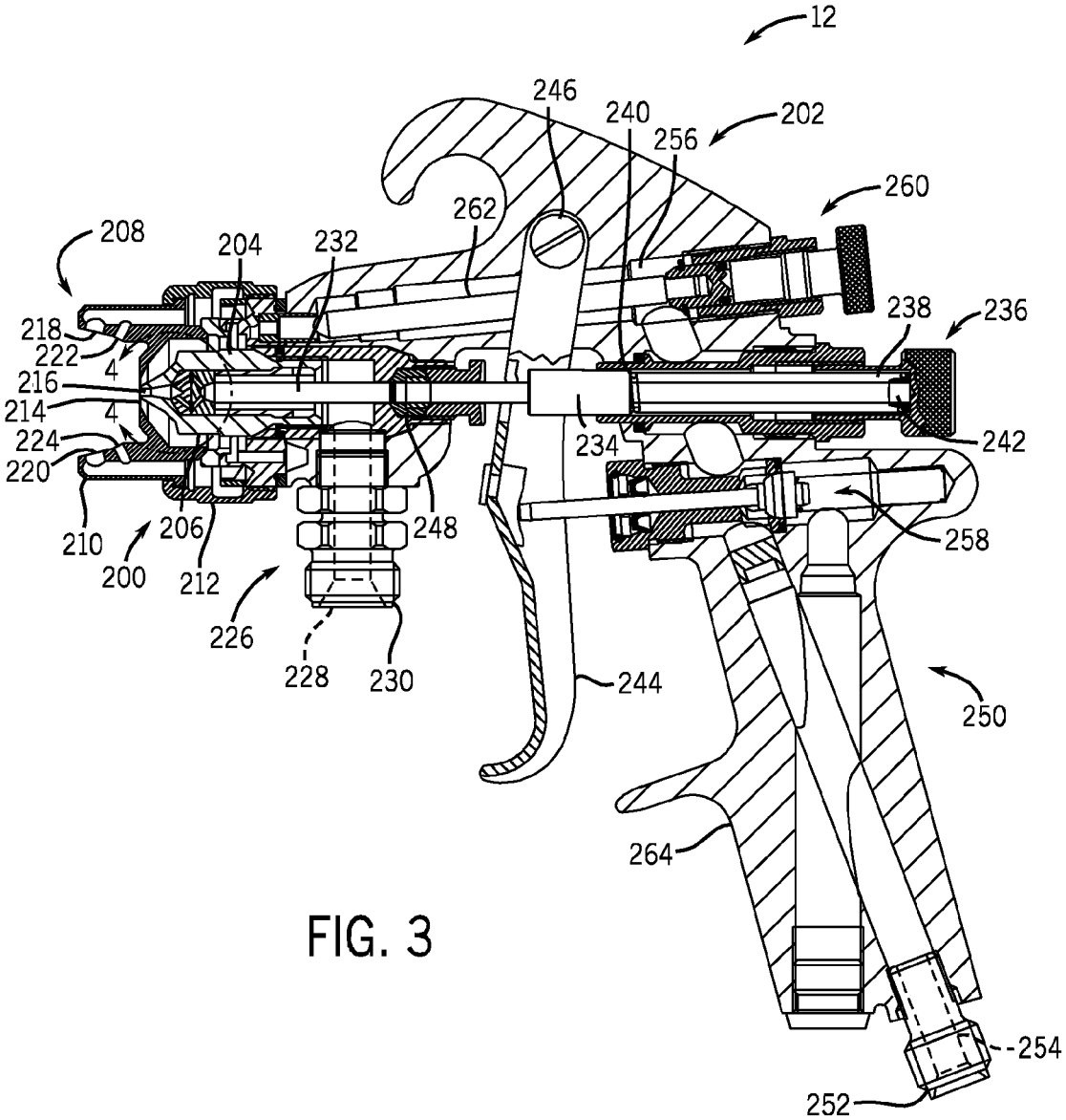
FIG. 3 is a cross-sectional side view of an exemplary spray coating device used in the spray coating system and method of FIGS. 1 and 2.

FIG. 3 is a cross-sectional side view illustrating an exemplary embodiment of the spray coating device 12. As illustrated, the spray coating device 12 comprises a spray tip assembly 200 coupled to a body 202. The spray tip assembly 200 includes a fluid delivery tip assembly 204, which may be removably inserted into a receptacle 206 of the body 202. For example, a plurality of different types of spray coating devices may be configured to receive and use the fluid delivery tip assembly 204. The spray tip assembly 200 also includes a spray formation assembly 208 coupled to the fluid delivery tip assembly 204. The spray formation assembly 208 may include a variety of spray formation mechanisms, such as air, rotary, and electrostatic atomization mechanisms. However, the illustrated spray formation assembly 208 comprises an air atomization cap 210, which is removably secured to the body 202 via a retaining nut 212. The air atomization cap 210 includes a variety of air atomization orifices, such as a central atomization orifice 214 disposed about a fluid tip exit 216 from the fluid delivery tip assembly 204. The air atomization cap 210 also may have one or more spray shaping orifices, such as spray shaping orifices 218, 220, 222, and 224, which force the spray to form a desired spray pattern (e.g., a flat spray). The spray formation assembly 208 also may comprise a variety of other atomization mechanisms to provide a desired spray pattern and droplet distribution.

The body 202 of the spray coating device 12 includes a variety of controls and supply mechanisms for the spray tip assembly 200. As illustrated, the body 202 includes a fluid delivery assembly 226 having a fluid passage 228 extending from a fluid inlet coupling 230 to the fluid delivery tip assembly 204. The fluid delivery assembly 226 also comprises a fluid valve assembly 232 to control fluid flow through the fluid passage 228 and to the fluid delivery tip assembly 204. The illustrated fluid valve assembly 232 has a needle valve 234 extending movably through the body 202 between the fluid delivery tip assembly 204 and a fluid valve adjuster 236. The fluid valve adjuster 236 is rotatably adjustable against a spring 238 disposed between a rear section 240 of the needle valve 234 and an internal portion 242 of the fluid valve adjuster 236. The needle valve 234 is also coupled to a trigger 244, such that the needle valve 234 may be moved inwardly away from the fluid delivery tip assembly 204 as the trigger 244 is rotated counter clockwise about a pivot joint 246. However, any suitable inwardly or outwardly openable valve assembly may be used within the scope of the present technique. The fluid valve assembly 232 also may include a variety of packing and seal assemblies, such as packing assembly 248, disposed between the needle valve 234 and the body 202.

An air supply assembly 250 is also disposed in the body 202 to facilitate atomization at the spray formation assembly 208. The illustrated air supply assembly 250 extends from an air inlet coupling 252 to the air atomization cap 210 via air passages 254 and 256. The air supply assembly 250 also includes a variety of seal assemblies, air valve assemblies, and air valve adjusters to maintain and regulate the air pressure and flow through the spray coating device 12. For example, the illustrated air supply assembly 250 includes an air valve assembly 258 coupled to the trigger 244, such that rotation of the trigger 244 about the pivot joint 246 opens the air valve assembly 258 to allow air flow from the air passage 254 to the air passage 256. The air supply assembly 250 also includes an air valve adjustor 260 coupled to a needle 262, such that the needle 262 is movable via rotation of the air valve adjustor 260 to regulate the air flow to the air atomization cap 210. As illustrated, the trigger 244 is coupled to both the fluid valve assembly 232 and the air valve assembly 258, such that fluid and air simultaneously flow to the spray tip assembly 200 as the trigger 244 is pulled toward a handle 264 of the body 202. Once engaged, the spray coating device 12 produces an atomized spray with a desired spray pattern and droplet distribution. Again, the illustrated spray coating device 12 is only an exemplary device of the present technique. Any suitable type or configuration of a spraying device may benefit from the unique fluid mixing, particulate breakup, and refined atomization aspects of the present technique.

Figure 4:
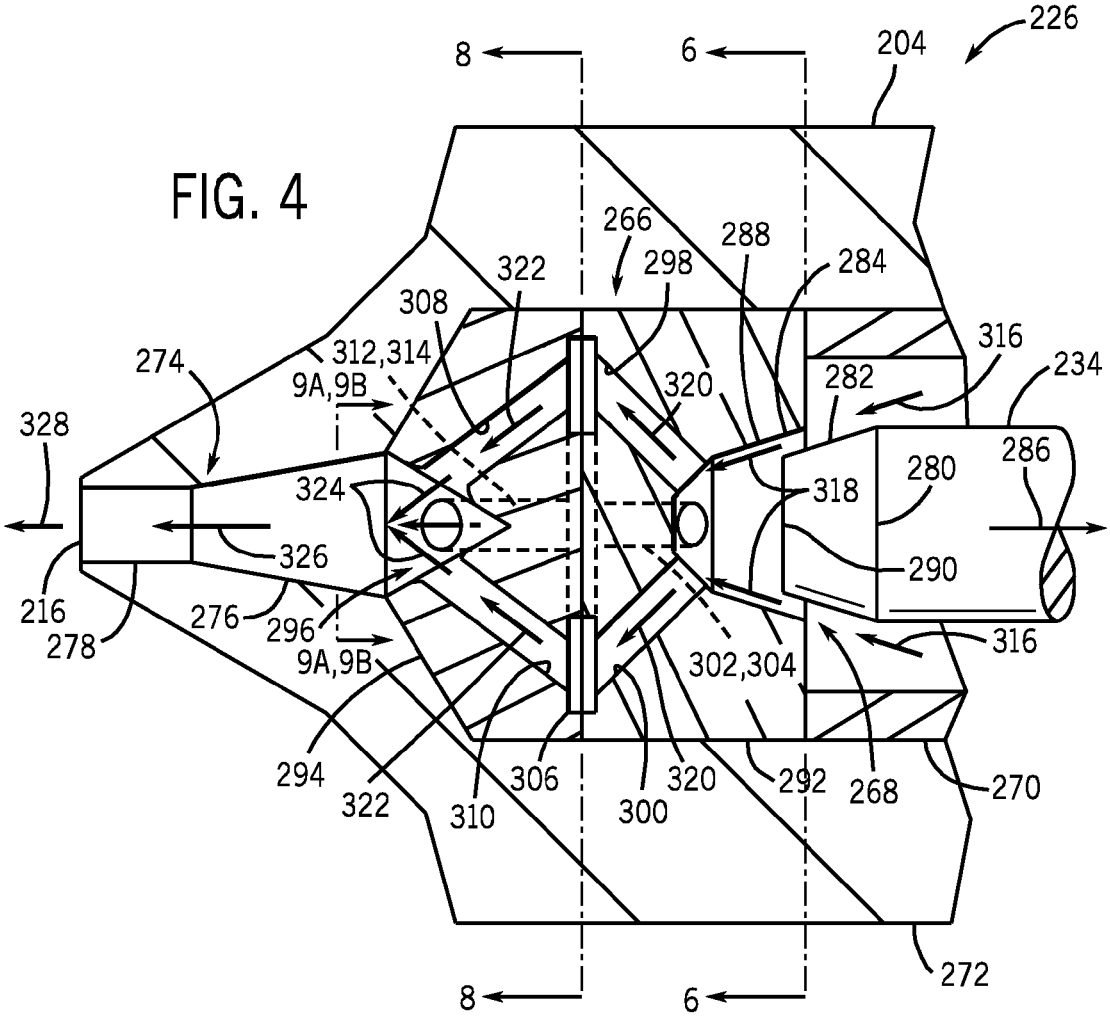
FIG. 4 is a partial cross-sectional side view of exemplary fluid mixing and breakup sections and a blunt-tipped fluid valve within a fluid delivery tip assembly of the spray coating device of FIG. 3.

FIG. 4 is a cross-sectional side view of the fluid delivery tip assembly 204. As illustrated, the fluid delivery tip assembly 204 comprises a fluid breakup section 266 and a fluid mixing section 268 disposed within a central passage 270 of a housing 272, which may be removably inserted into the receptacle 206 of the body 202. Downstream of the fluid breakup section 266, the central passage 270 extends into a fluid tip exit passage 274, which has a converging section 276 followed by a constant section 278 adjacent the fluid tip exit 216. Any other suitable fluid tip exit geometry is also within the scope of the present technique. Upstream of the fluid breakup section 266 and the fluid mixing section 268, the needle valve 234 controls fluid flow into and through the fluid delivery tip assembly 204. As illustrated, the needle valve 234 comprises a needle tip 280 having an abutment surface 282, which is removably sealable against an abutment surface 284 of the fluid mixing section 268. Accordingly, as the user engages the trigger 244, the needle valve 234 moves inwardly away from the abutment surface 284 as indicated by arrow 286. The desired fluid then flows through the fluid delivery tip assembly 204 and out through the fluid tip exit 216 to form a desired spray via the spray formation assembly 208.

As described in further detail below, the fluid breakup and mixing sections 266 and 268 are configured to facilitate fluid mixing and the breakup of particulate/ligaments within the desired fluid prior to exiting through the fluid tip exit 216. Accordingly, the present technique may utilize a variety of structures, passageways, angles, and geometries to facilitate fluid mixing and particulate breakup within the fluid delivery tip assembly 204 prior to external atomization via the spray formation assembly 208. In this exemplary embodiment, the fluid mixing section 268 has a mixing cavity 288 disposed adjacent a blunt edge 290 of the needle tip 280, such that fluid flowing past the blunt edge 290 is induced to mix within the mixing cavity 288. Fluid mixing is relatively strong within the mixing cavity 288 due to the velocity differential between the fluid flowing around the needle tip 280 and the substantially blocked fluid within the mixing cavity. Moreover, the blunt edge 290 provides a relatively sharp interface between the high and low speed fluid flows, thereby facilitating swirl and vortical structures within the fluid flow. Any other suitable mixture-inducing structure is also within the scope of the present technique.

The mixing cavity 288 extends into and through the fluid breakup section 266 via one or more fluid passageways. As illustrated, the fluid breakup section 266 comprises a diverging passing section 292 coupled to the mixing cavity 288, a converging passage section 294 coupled to the diverging passage section 292, and a fluid impingement region 296 positioned downstream of the converging passage section 294. The diverging passage section 292 comprises passages 298, 300, 302, and 304, which diverge outwardly from the mixing cavity 288 toward an annular passageway 306 disposed between the diverging and converging passage sections 292 and 294. The converging passage section 294 comprises passages 308, 310, 312, and 314, which converge inwardly from the annular passage 306 toward the fluid impingement region 296. In other words, the passages 308, 310, 312, and 314 have axes (not shown), which converge or direct fluid jets to substantially impinge one another downstream from the passages 308, 310, 312, and 314. For example, the converging passages 308, 310, 312, and 314 may orient the fluid jets exiting the passages 308, 310, 312, and 314 to intersect directly (i.e., jet axes intersect one another) or to engage one another partially (i.e., jets contact one another at outer edges). Moreover, the passages 308, 310, 312, and 314 may direct the fluid jets to create a rotating or swirling motion of the fluid jets (in the impingement region 296) with or without impingement of the fluid jets.

In operation, the desired fluid flows through the central passage 270, through the mixing cavity 288, through the passages 298-304 of the diverging passage section 292, through the passages 308-314 of the converging passage section 294, into the fluid impingement region 296 as fluid jets convergingly toward one another, through the fluid tip exit passage 274, and out through the fluid tip exit 216, as indicated by arrows 316, 318, 320, 322, 324, 326, and 328, respectively. As discussed in further detail below, the fluid breakup section 266 may have any suitable configuration of passages directed toward a surface or toward one another, such that the fluid collides/impinges/swirls in a manner causing particulate/ligaments in the fluid to breakup.

Figure 5:
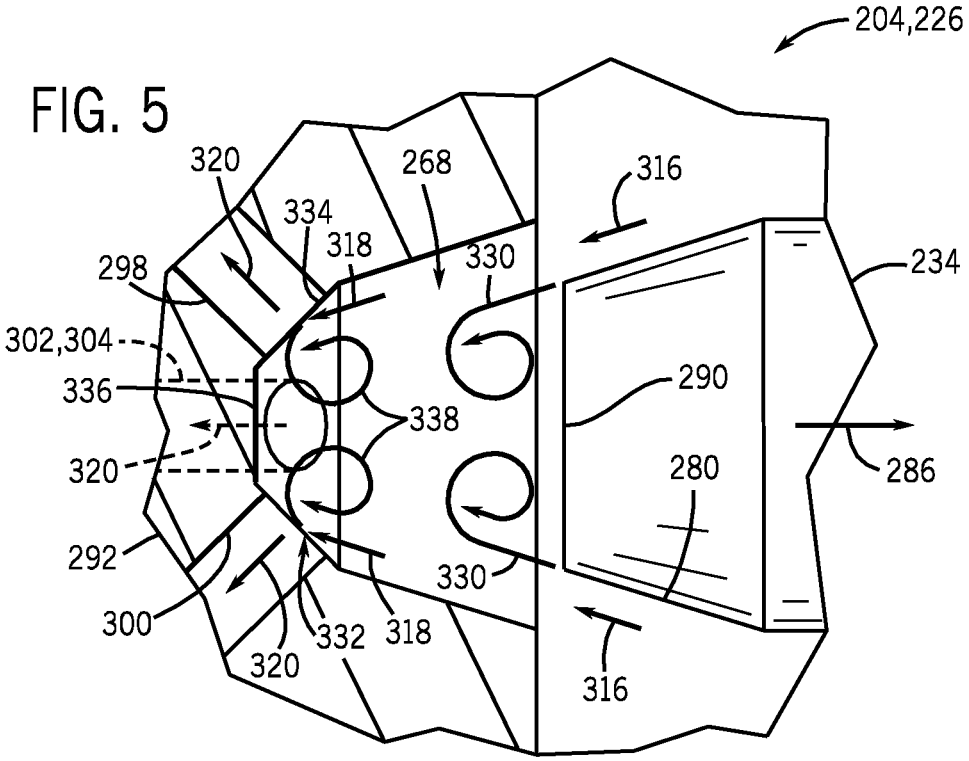
FIG. 5 is a partial cross-sectional side view of the fluid delivery tip assembly of FIG. 4 further illustrating the blunt-tipped fluid valve, the fluid mixing section, and a diverging passage section of the fluid breakup section.

FIG. 5 is a partial cross-sectional side view of the fluid delivery tip assembly 204 further illustrating the needle valve 234, the fluid mixing section 268, and the diverging passage section 292. As illustrated, the desired fluid flows around the needle tip 280 and swirls past the blunt edge 290, as indicated by arrows 316 and 330, respectively. Accordingly, the blunt edge 290 of the needle tip 280 induces fluid mixing downstream of the needle valve 234. For example, the blunt edge 290 may facilitate turbulent flows and fluid breakup within the fluid mixing section 268. It should be noted that the mixing section 268 may induce fluid mixing by any suitable sharp or blunt edged structure, abruptly expanding or contracting passageway, or any other mechanism producing a velocity differential that induces fluid mixing. As the fluid flows into the fluid mixing section 268, the fluid collides against a flow barrier 332, which has an angled surface 334 extending to a vertical surface 336. The flow barrier 332 reflects a substantial portion of the fluid flow back into the fluid mixing section 268, such that the fluid flow swirls and generally mixes within the fluid mixing section 268, as indicated by arrows 338. The mixed fluid then flows from the fluid mixing section 268 into the fluid breakup section 266 via the passages 298, 300, 302, and 304, as indicated by arrows 320. As illustrated, the passages 298-304 have a relatively smaller geometry than the mixing cavity 288. This abruptly contracting flow geometry effectively slows the flow within the fluid mixing section 268 and forces the fluid to mix prior to moving forward through the fluid breakup section 266. The abruptly contracting flow geometry also accelerates the fluid flow through the fluid breakup section 266, thereby creating relatively high speed fluid jets that are directed toward an impingement region.

Figure 6:
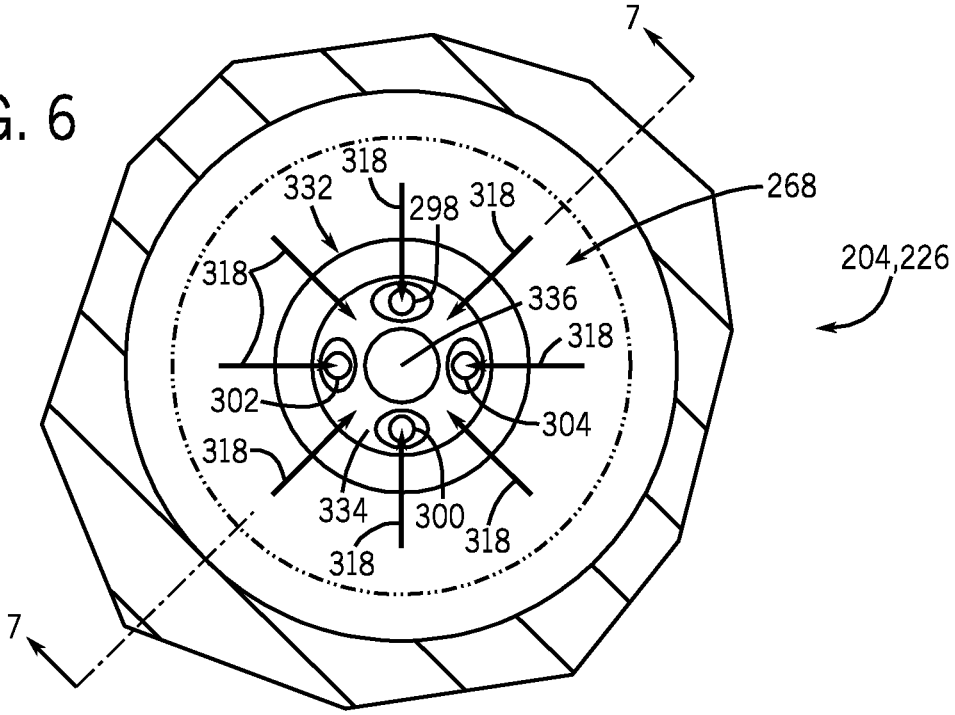
FIG. 6 is a partial cross-sectional face view of the fluid mixing section illustrated in FIG. 5.

FIG. 6 is a cross-sectional face view of the fluid mixing section 268 illustrated by FIG. 4. As noted above, the fluid flows into the fluid mixing section 268 and strikes the flow barrier 332, as indicated by arrows 318. Although some of the fluid may be directed straight into the passages 300-304, a significant portion of the fluid strikes the angled and vertical surfaces 334 and 336 of the flow barrier 332 surrounding the passages 300-304. Accordingly, the flow barrier 332 reflects and slows the fluid flow, such that the fluid mixes within the fluid mixing section 268. Fluid mixing is also induced by the geometry of the needle valve 234. For example, the blunt edge 290 creates a velocity differential that facilitates fluid mixing between the fluid entering the fluid mixing section 268 and the fluid substantially blocked within the fluid mixing section 268. The mixing induced by the flow barrier 332 and the blunt edge 290 may provide a more homogenous mixture of the desired fluid, while also breaking down particulate within the fluid. Again, any suitable mixture-inducing geometry is within the scope of the present technique.

Figure 7:
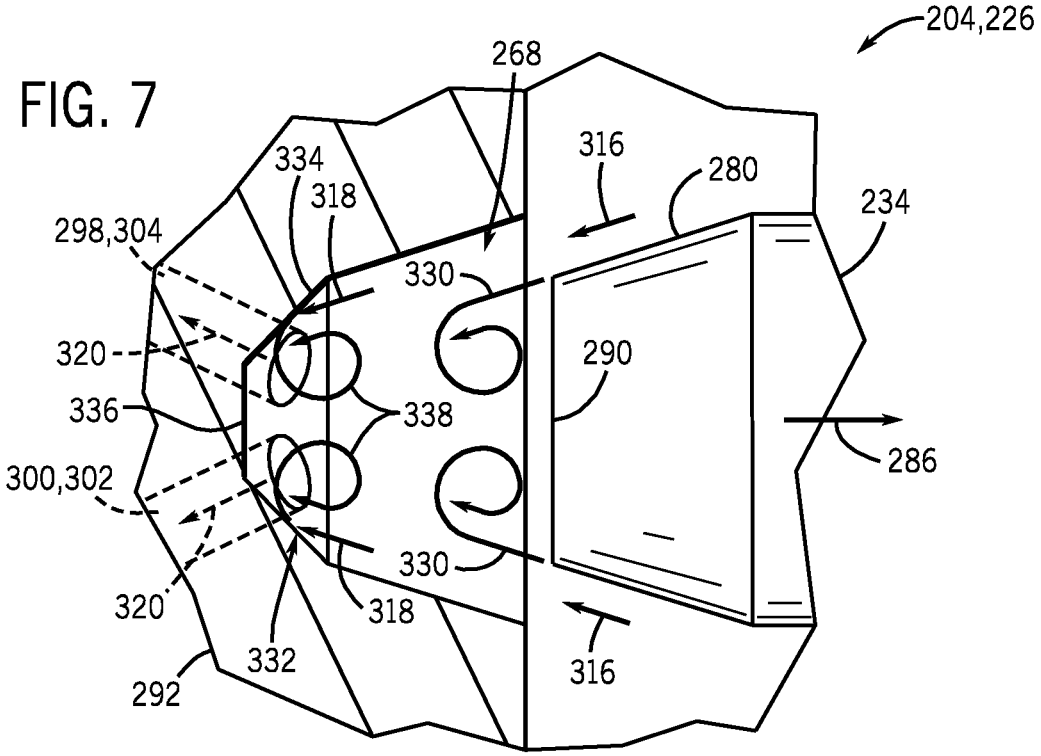
FIG. 7 is a partial cross-sectional side view of the fluid delivery tip assembly of FIGS. 4 and 5 further illustrating the blunt-tipped fluid valve, the fluid mixing section, and the diverging passage section rotated 45 degrees as indicated in FIG. 6.

FIG. 7 is a partial cross-sectional side view of the fluid mixing section 268 of FIG. 5 rotated 45 degrees as indicated by FIG. 6. In the illustrated orientation of the flow barrier 332, it can be seen that a significant portion of the fluid does not flow directly into the passages 300-304, but rather the fluid strikes and reflects off of the flow barrier 332, as indicated by arrows 338. Accordingly, the fluid is mixed and broken up into a more consistent mixture within the fluid mixing section 268. It also should be noted that the present technique may have any suitable size, geometry, or structure for the mixing cavity 288, the flow barrier 332, and the needle tip 280. For example, the particular angles and flow capacities within the fluid mixing section 268 may be selected to facilitate fluid mixing and breakup for a particular fluid and spraying application. Certain fluid characteristics, such as viscosity and degree of fluid particulate, may require a certain flow velocity, passage size, and other specific structures to ensure optimal fluid mixing and breakup through the spray coating device 12.

Figure 8:
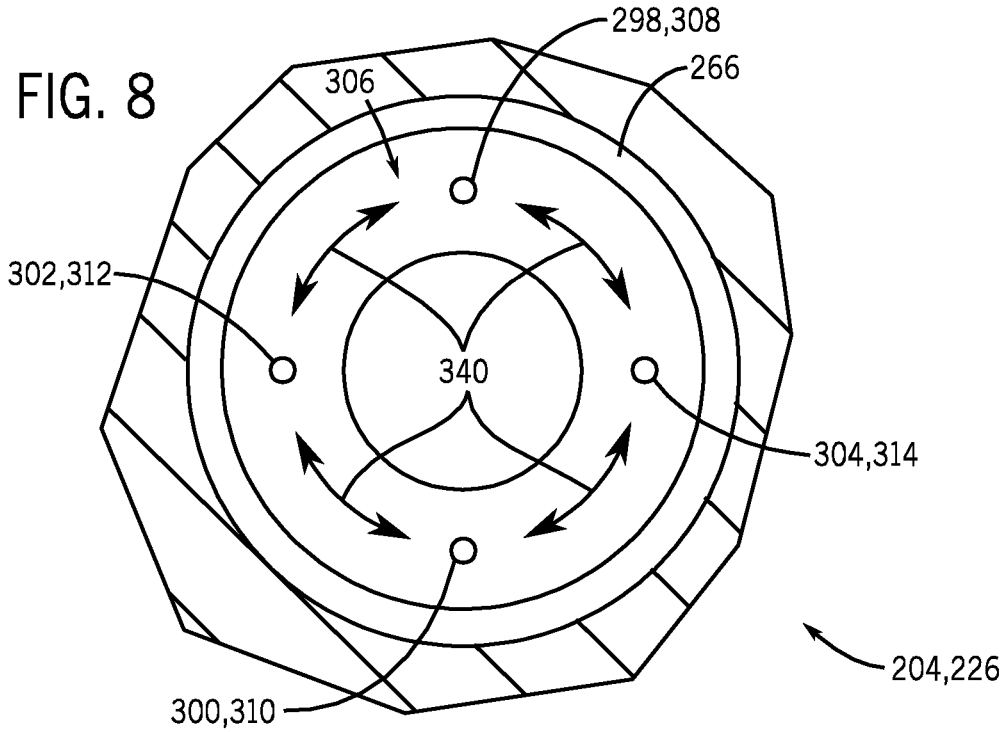
FIG. 8 is a partial cross-sectional face view of an intermediate passage between the diverging passage section and a converging passage section of the fluid breakup section illustrated in FIG. 4.

FIG. 8 is a cross-sectional face view of the angular passage 306 illustrating fluid flow between the passages entering and exiting the annular passage 306 via the diverging and converging sections 292 and 294. As discussed above, fluid flows from the fluid mixing section 268 to the annular passage 306 via the passages 298-304 of the diverging passage section 292. The annular passage 306 substantially frees/unrestricts the fluid flow relative to the restricted geometries of the passages 300-304. Accordingly, the annular passage 306 unifies and substantially equalizes the fluid flow, as indicated by arrows 340. The substantially equalized fluid flow then enters the passages 308-314 of the converging passage section 294, where the fluid flow is directed inwardly toward the fluid impingement region 296. It should be noted that the present technique may have any suitable form of intermediate region between the diverging and converging passage sections 292 and 294. Accordingly, the passages 298-304 may be separately or jointly coupled to passages 308-314 via any suitable interface. The present technique also may utilize any desired number of passages through the converging and diverging sections 292 and 294. For example, a single passage may extend through the diverging passage section 292, while one or multiple passages may extend through the converging passage section 294.

Figure 9:
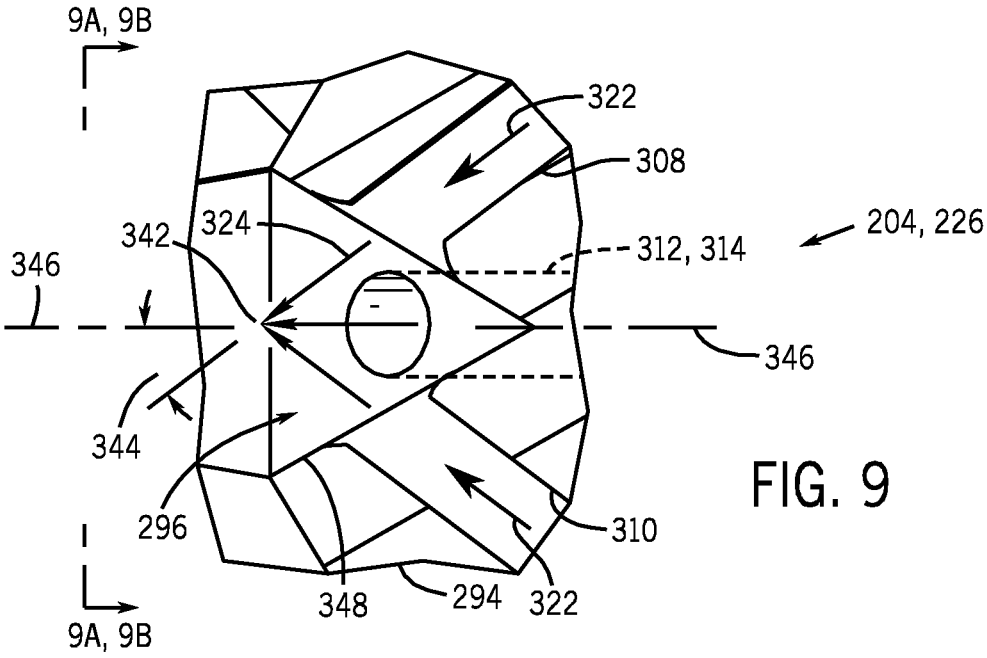
FIG. 9 is a partial cross-sectional side view of the fluid delivery tip assembly of FIG. 4 further illustrating a fluid impingement region of the fluid breakup section.

FIG. 9 is a partial cross-sectional side view of the fluid breakup section 266 illustrating the converging passage section 294 and the fluid impingement region 296. As illustrated, the fluid flows through passages 308-314 of the converging passage section 294 inwardly toward the fluid impingement region 296, such that the fluid collides at a desired angle. For example, the passages 308-314 may be directed toward an impingement point 342 at an impingement angle 344 relative to a centerline 346 of the fluid breakup section 266. The impingement angle 344 may be selected to optimize fluid breakup based on characteristics of a particular fluid, desired spray properties, a desired spray application, and various other factors. The selected impingement angle 344, geometries of the passages 308-314, and other application-specific factors collectively optimize the collision and breakup of fluid particulate/ligaments within the fluid impingement region 296. For example, in certain applications, the impingement angle 344 may be in a range of 25-45 degrees. In certain wood spraying applications, and many other applications, an impingement angle of approximately 37 degrees may be selected to optimize fluid particulate breakup. If the fluid jets are impinged toward one another as illustrated in FIG. 9, then the impingement angle may be in a range of 50-90 degrees between the fluid jets flowing from the passages 308-314. Again, certain spraying applications may benefit from an impingement angle of approximately 74 degrees between the fluid jets. However, the present technique may select and utilize a wide variety of impingement angles and flow passage geometries to optimize the fluid mixing and breakup. The fluid impingement region 296 also may be disposed within a recess of the converging passage section 294, such as a conic cavity 348.

Figure 9A:
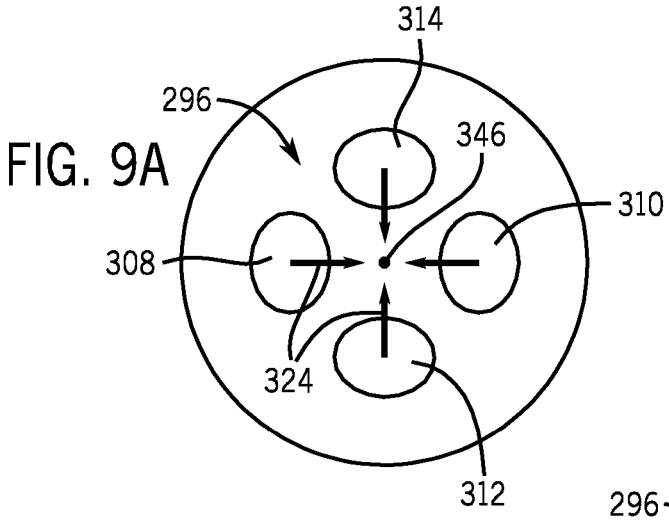
FIG. 9A is a cross-sectional face view of the region of the fluid breakup section illustrated in FIG. 9 illustrating jets directed to impinge one another in accordance with embodiments of the present technique.
Figure 9B:
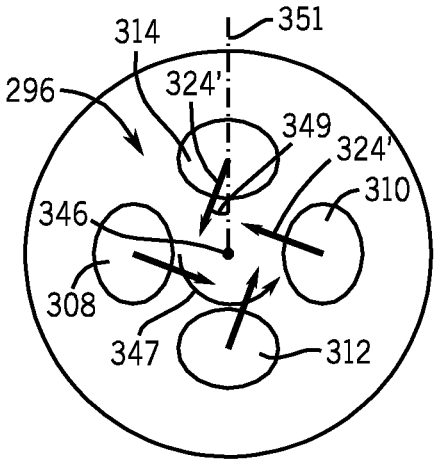
FIG. 9B is a cross-sectional face view of the region of the fluid break up section illustrated in FIG. 9, but depicting the upstream converging passage section configured to create a fluid swirling motion in the downstream region in accordance with other embodiments of the present technique.

FIGS. 9A and 9B are cross-sectional face views of the fluid impingement region 296 of the fluid breakup section 266 depicted in FIG. 9 in accordance with alternative embodiments of the present technique. FIG. 9A illustrates passages 308-314 configured to impinge fluid streams 324 directed at the central axis 346 of the fluid path. In contrast, FIG. 9B illustrates passages 308'-314' configured to direct the fluid streams 324' offset around the central axis 346 (longitudinal axis), which provides a rotating or swirling motion of the fluid around the central axis 346 in the impingement region 296, as indicated by arrow 347 (with or without impingement). The configuration may give, for example, fluid streams that longitudinally converge but are radially offset relative to a longitudinal flow axis. In other words, the passages 308' to 314' may be oriented to direct the third streams 324' at an offset angle 349 relative to a radial line 351, such that the fluid streams 324' pass the central axis 346 at offset distance.

The offset angle 349 is in a different plane than the impingement angle 344 previously discussed (see FIG. 9). As illustrated, the offset angle 349 is defined or measured with respect to the radial line 351 (e.g., an axis orthogonal to the central axis 346) in the same plane as FIGS. 9A and 9B, whereas the impingement angle 344 is defined or measured with respect to the central axis 346 in the same plane as FIG. 9. In certain embodiments, the offset angle 349 may be selected based on the particular spray application, the properties of the fluid (e.g., viscosity and other fluid characteristics), on the desired flow and mixing regimes, (e.g., the desired level of turbulence, swirling, and the like), and other flow features. The offset angle 349 may be configured to create a fluid swirling motion in the impingement region 296 without actual impingement of the fluid streams 324'. Also, the offset angle 349 may be specified to generate a fluid swirling motion around an axis other than the central axis 346. Moreover, the offset injection of the fluid jets (e.g., FIG. 9B) may apply to other embodiments of the present technique, such as those illustrated in FIGS. 11, 13, 14, and 15.

Figure 10:
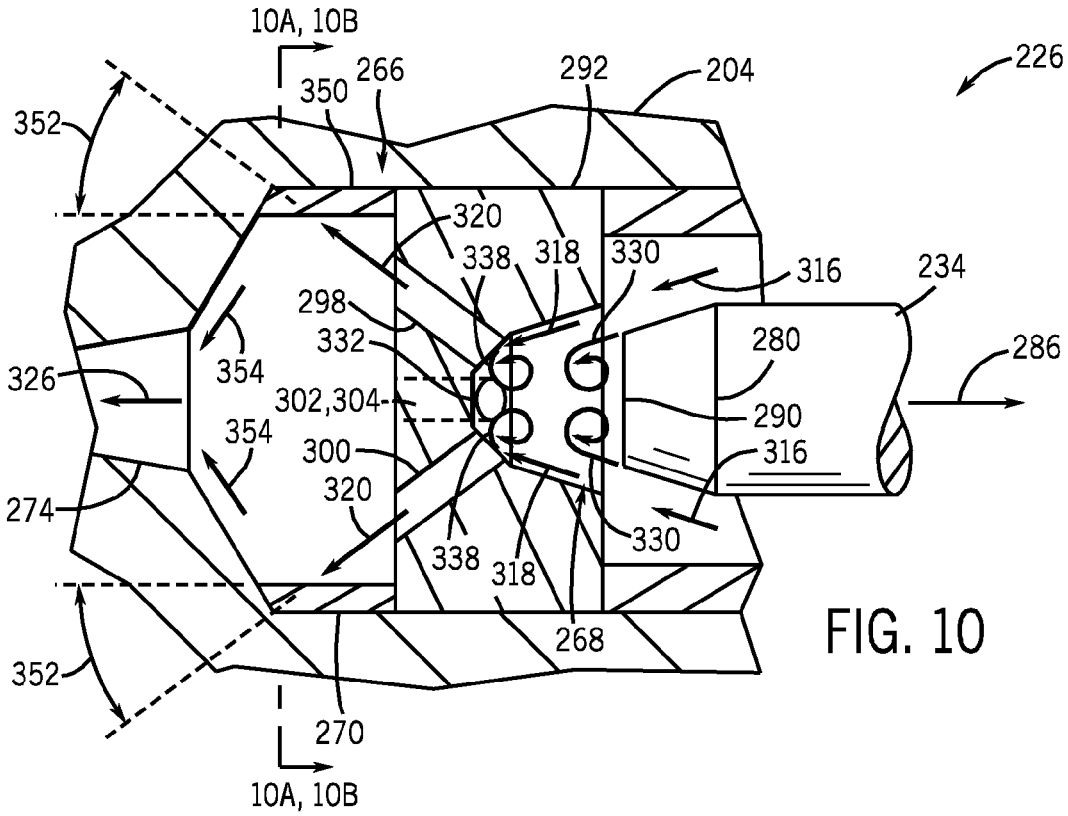
FIG. 10 is a partial cross-sectional side view of an alternative embodiment of the fluid delivery tip assembly of FIG. 4 having the diverging passage section without the converging passage section illustrated in FIG. 9.

FIG. 10 is a cross-sectional side view of the fluid delivery tip assembly 204 illustrating an alternative embodiment of the fluid breakup section 266. As illustrated, the fluid breakup section 266 includes the diverging passage section 292 adjacent an annular spacer 350 without the converging passage section 294. Accordingly, in an open position of the needle valve 234, fluid flows past the needle tip 280, through the fluid mixing section 268, through the passages of 298-304 of the diverging passage section 292, colliding onto an interior of the annular spacer 350 at an impingement angle 352, through the central passage 270 within the annular spacer 350, and out through the fluid tip exit passage 274, as indicated by arrows 316, 318, 320, 354, and 326, respectively. In this exemplary embodiment, impinging fluid jets are ejected from the passages 298-304 of the diverging passage section 292, rather than from the passages 308-314 of the converging passage section 294. These relatively high speed fluid jets then impinge a surface (i.e., the interior of the annular spacer 350), rather than impinging one another. Again, the impingement angle 352 is selected to facilitate fluid breakup of particulate/ligaments based on the fluid characteristics and other factors. Accordingly, the impingement angle 352 may be within any suitable range, depending on the application. For example, the particular impingement angle 352 may be selected to optimize fluid breakup for a particular coating fluid, such as a wood stain, and a particular spraying application. As discussed above, the impingement angle 352 may be in a range of 25-45 degrees, or approximately 37 degrees, for a particular application. It also should be noted that the present technique may use any one or more surface impinging jets, such as those illustrated in FIG. 10. For example, a single impinging jet may be directed toward a surface of the annular spacer 350. The fluid breakup section 266 also may have multiple fluid jets directed toward one another or toward one or more shared points on the interior surface of the annular spacer 350.

Figure 10A:
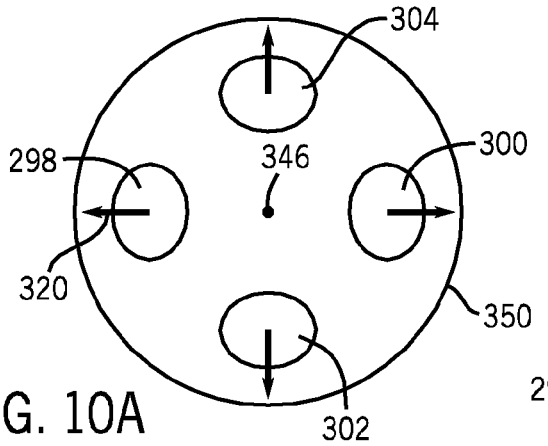
FIG. 10A is a partial cross-sectional face view of the fluid delivery tip assembly of FIG. 10 illustrating jets directed outward to impinge surfaces in accordance with embodiments of the present technique.
Figure 10B:
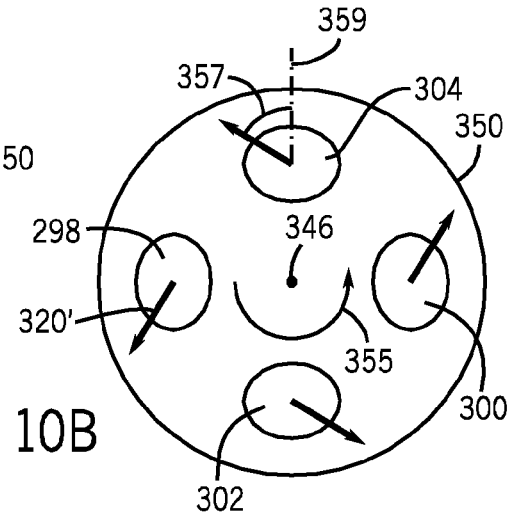
FIG. 10B is a partial cross-sectional face view of the fluid delivery tip assembly of FIG. 10 illustrating an alternate embodiment of the converging passage section that directs jets downstream toward surfaces at angles around a central axis to create a fluid swirl.

FIGS. 10A and 10B are partial cross-sectional face views of the fluid delivery tip assembly 204 of FIG. 10 further illustrating alternative configurations for impingement of the fluid jets or streams against a surface (e.g., inner surface of spacer 350) in the fluid breakup section 266. FIG. 10A illustrates passages 298-304 configured to give impingement of the fluid streams 320 against the spacer 350 in a direction radially outward from the central axis 346. In contrast, FIG. 9B illustrates passages 298'-304' configured to impinge the fluid streams 320' against the spacer 350 in a non-radial direction relative to the central axis 346 to the inner surface of the spacer 350. In other words, the passages 398'-304' are oriented to direct the fluid streams 320' at an offset angle 357 relative to a radial line 359, which extends outwardly from the central axis 346 to the inner surface of the spacer 305. As a result of this offset angle 357, the fluid streams 320' impinge and rotate around the inner surface of the spacer 350 (e.g., a swirling motion of the fluid), as indicated by arrow 355. The offset angle 357, which is in a different plane than the impingement angle 352 of FIG. 10, may be specified based on the particular spray application, the properties of the fluid, (e.g., viscosity and other fluid characteristics), the desired flow and mixing regimes, (e.g., the desired level of turbulence, and swirling), and so forth.

As mentioned above, the spray coating device 12 may have a variety of different valve assemblies 232 to facilitate fluid mixing and breakup in the fluid delivery tip assembly 204. For example, one or more mixture-inducing passages or structures may be formed on or within the needle valve 234 to induce fluid mixing. FIGS. 11-15 illustrate several exemplary needle valves, which may enhance fluid mixing in the fluid mixing section 268.

Figure 11:
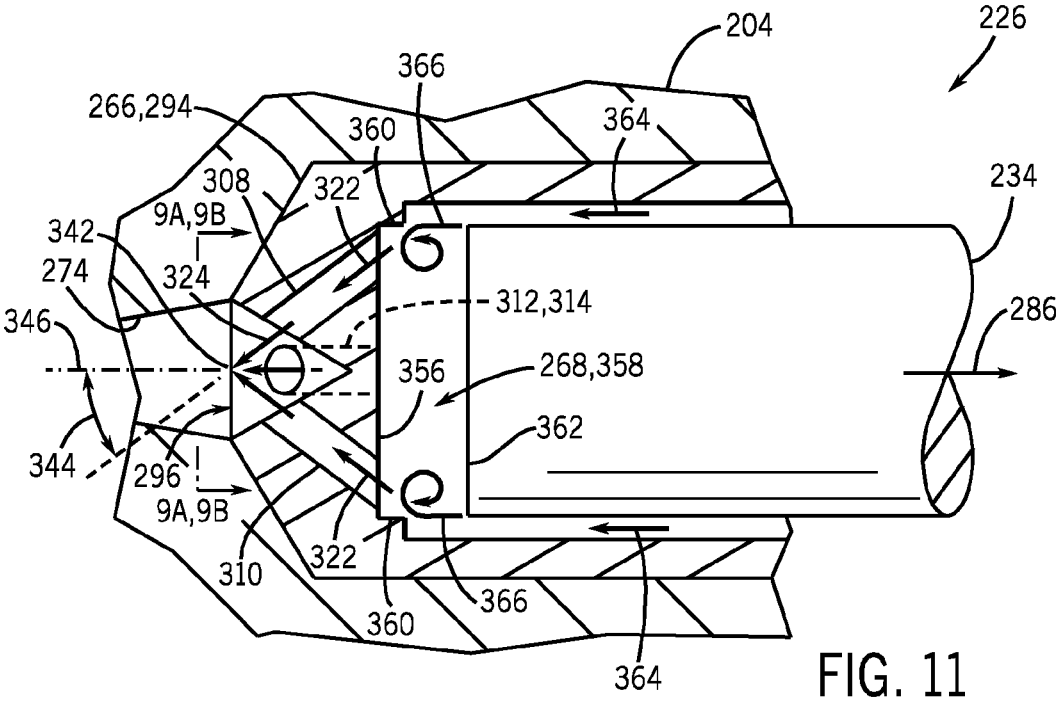
FIG. 11 is a partial cross-sectional side view of another alternative embodiment of the fluid delivery tip assembly of FIG. 4 having the converging passage section without the diverging passage section illustrated in FIGS. 5 and 7.

FIG. 11 is a cross-sectional side view of the fluid delivery tip assembly 204 illustrating an alternative embodiment of the needle valve 234 and the fluid breakup and mixing sections 266 and 268. The illustrated fluid breakup section 266 has the converging passage section 294 without the diverging passage section 292. Moreover, the illustrated fluid mixing section 268 has a vertical flow barrier 356 within an annular mixing cavity 358, rather than having the multi-angled mixing cavity 288 illustrated by FIG. 4. The annular cavity 358 also has a stepped portion 360 for sealing engagement with the needle valve 234 in a closed position. The illustrated needle valve 234 also has a blunt tip 362 to facilitate mixing within the fluid mixing section 268. In an open position of the needle valve 234, fluid flows around the needle valve 234, past the blunt tip 362, into the passages 308-314 of the converging passage section 294, and convergingly inward toward the impingement point 342 within the fluid impingement region 296, as indicated by arrows 364, 366, 322, and 324, respectively. In the fluid mixing section 268, the blunt tip 362 of the needle valve 234 facilitates fluid swirl and general mixing, as illustrated by arrows 366. The flow barrier 356 also facilitates fluid mixing within the fluid mixing section 268 between the flow barrier 356 and the blunt tip 362 of the needle valve 234. Moreover, the flow barrier 356 restricts the fluid flow into the restricted geometries of the passages 308-314, thereby creating relatively high speed fluid jets ejecting into the fluid impingement region 296. Again, the impingement angles 344 of these fluid jets and passages 308-314 are selected to facilitate fluid breakup for a particular fluid and application. For example, a particular fluid may breakup more effectively at a particular collision/impingement angle and velocity, such as an angle of approximately 37 degrees relative to the centerline 346.

FIG. 12 is a cross-sectional side view of the fluid delivery tip assembly 204 illustrating another alternative embodiment of the needle valve 234 and the fluid breakup and mixing sections 266 and 268. As illustrated, the fluid breakup section 266 has a converging passage section 368, which has passages 370 extending from the fluid mixing section 268 convergingly toward a conical cavity 372. The fluid mixing section 268 comprises an annular cavity 374 between a blunt tip 376 of the needle valve 234 and a vertical flow barrier 378 formed at an entry side of the converging passage section 368. The annular cavity 374 has a stepped portion 380, which is sealable against the needle valve 234 in a closed position. In this exemplary embodiment, the needle valve 234 has a shaft 382 extending moveably through a central passage 384 of the converging passage section 368. At a downstream side of the converging passage section 368, the needle valve 234 has a wedge shaped head 386 extending from the shaft 382. The wedge shaped head 386 is positionable within an impingement region 388 in the conical cavity 372. Accordingly, in an open position of the needle valve 234, fluid flows along the needle valve 234, past the blunt tip 376 in a swirling motion, through the passages 370 in an impinging path toward the wedge shaped head 386, and out through the fluid tip exit passage 274, as indicated by arrows 364, 366, 390, and 326, respectively.

In operation, the blunt tip 376 and the vertical flow barrier 378 facilitate fluid mixing and breakup within the fluid mixing section 268. Further downstream, the fluid jets ejecting from the passages 370 impinge against the wedge shaped head 386 to facilitate the breakup of fluid particulate/ligaments within the fluid. Again, the particular impingement angle of the fluid jets colliding with the wedge shaped head 386 may be selected based on the fluid characteristics and desired spray application. Moreover, the particular size and geometry of the passages 370 may be selected to facilitate a desired velocity of the fluid jets 390. The configuration and structure of the shaft 382 and head 386 also may be modified within the scope of the present technique. For example, the head 386 may have a disk-shape, a wedge-shape at the impingement side, one or more restricted passages extending therethrough, or the head 386 may have a hollow muffler-like configuration. The shaft 382 may have a solid structure, a hollow structure, a multi-shaft structure, or any other suitable configuration.

FIGS. 12A and 12B are partial cross-sectional face views of the fluid delivery tip assembly 204 of FIG. 12 further illustrating the conical cavity 372 within the fluid breakup section 266 in accordance with different embodiments of the present technique. FIG. 12A illustrates passages 370 configured to impinge the fluid jets 390 against the head 386 and to direct the fluid jets 390 radially inward toward the central axis of the shaft 382. In contrast, FIG. 12B illustrates passages 370' configured to impinge the fluid jets 390' against the head 386, but with the fluid jets 390' directed around the central axis of the shaft 382. Such an impingement around the central axis of the shaft 382 provides a swirling motion of the fluid within the conical cavity 372, as indicated by arrow 391, to facilitate mixing and breakup of the fluid. In other words, the passages 310' are oriented to direct the fluid jets 390' at an offset angle 393 relative to a radial line 395, which is orthogonal to the shaft 382 or central axis (not shown). The offset angle 393, which is in a different plane than the impingement angle discussed above for FIG. 12, may be specified based on the properties of the fluid (e.g., viscosity and other fluid characteristics), the desired flow and mixing regimes, (e.g., the desired level of turbulence and swirling), the particular spray application, and so forth.

Figure 13:
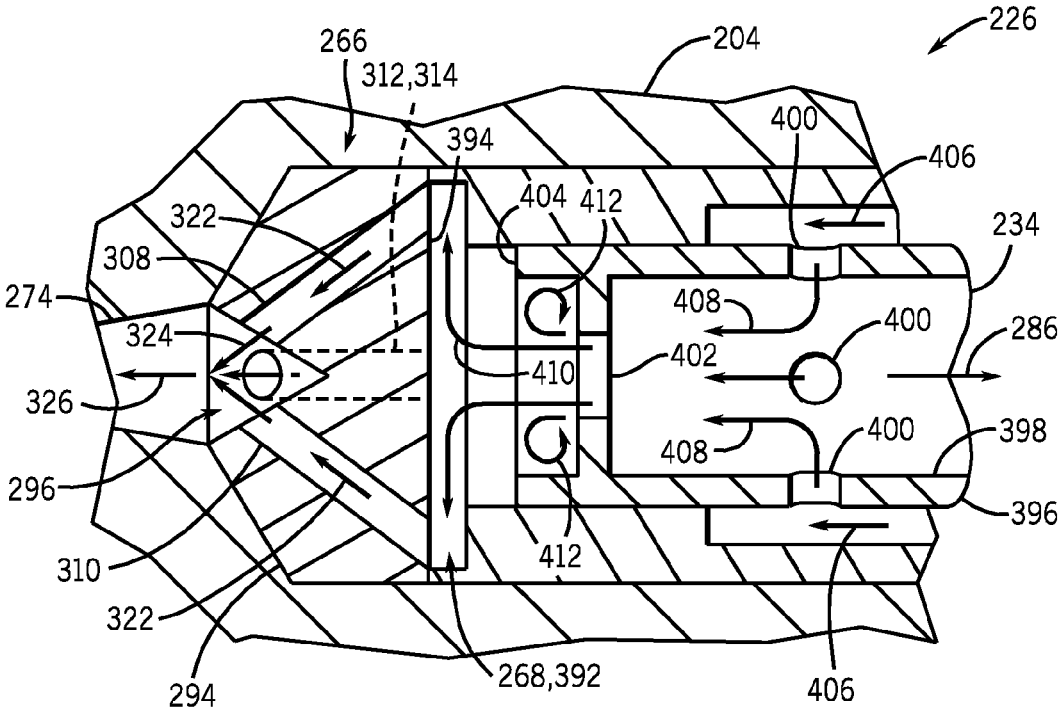
FIG. 13 is a partial cross-sectional side view of another alternative embodiment of the fluid delivery tip assembly of FIG. 4 having a hollow fluid valve adjacent the fluid mixing section.

FIG. 13 is a cross-sectional side view of the fluid delivery tip assembly 204 illustrating an alternative embodiment of the needle valve 234. As illustrated, the fluid delivery tip assembly 204 comprises the fluid breakup section 266 adjacent the converging passage section 294 without the diverging passage section 292. However, the alternative needle valve 234 illustrated in FIG. 13 may be used with any configuration of the fluid breakup section 266 and the fluid mixing section 268. In this exemplary embodiment, the fluid mixing section 268 comprises an annular mixing cavity 392 disposed between the needle valve 234 and a vertical flow barrier 394 at an entry side of the converging passage section 294. The illustrated needle valve 234 comprises a hollow shaft 396 having a central passage 398 and a plurality of entry and exit ports. For example, the hollow shaft 396 has a plurality of lateral entry ports 400 and a central exit port 402, which facilitates fluid mixing as the fluid flows past the entry and exit ports 400 and 402. As illustrated, the ports 400 and 402 create an abrupt contraction and expansion in the fluid flow path, such that ring vortices form and mixing is induced downstream of the ports 400 and 402.

In operation, the needle valve 234 shuts off the fluid flow by positioning a valve tip 404 against the vertical flow barrier 394, such that fluid flow cannot enter the passages 308-314. The needle valve 234 opens the fluid flow by moving the hollow shaft 396 outwardly from the vertical flow barrier 394, thereby allowing fluid to flow through the passages 308-314. Accordingly, in the open position, fluid flows around the hollow shaft 396, in through the ports 400, through the central passage 398, out through the port 402 and into the fluid mixing section 268, swirlingly past the port 402 at the abrupt expansion region, through the passages 308-314, convergingly into the impingement region 296, and out through the fluid tip exit passage 274, as indicated by arrows 406, 408, 410, 412, 322, 324, and 326, respectively. As mentioned above, the abruptly constricted and expanded geometries of the passages and ports extending through the hollow shaft 396 facilitates fluid mixing into the fluid mixing section 268, which further mixes the fluid flow prior to entry into the converging passage section 294. The fluid flow then increases velocity as it is restricted through the passages 308-314, thereby facilitating relatively high speed fluid collision in the fluid impingement region 296. Although FIG. 13 illustrates specific flow passages and geometries, the present technique may use any suitable flow geometries and passages through the needle valve 234 and the breakup and mixing sections 266 and 268 to facilitate pre-atomization fluid mixing and breakup of the fluid.

Figure 14:
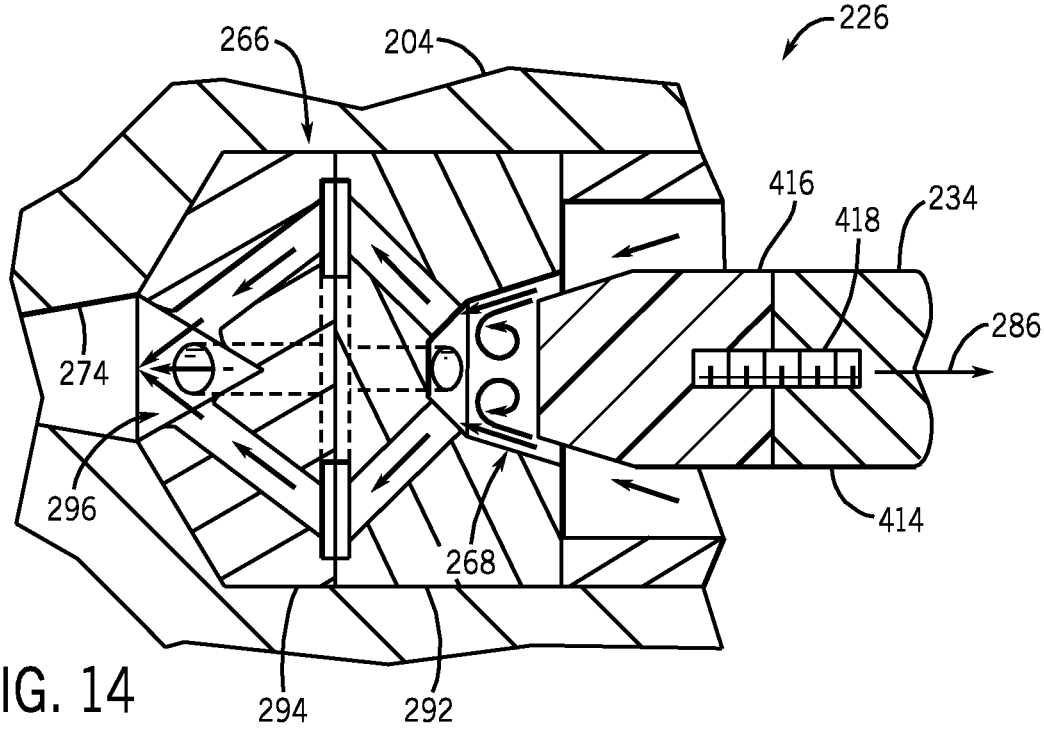
FIG. 14 is a partial cross-sectional side view of the fluid delivery tip assembly of FIG. 4 having an alternative fluid valve with a removable and replaceable tip section.

FIG. 14 is a cross-sectional side view of the fluid delivery tip assembly 204 illustrating an alternative multi-component needle valve 234. The illustrated needle valve 234 comprises a needle body section 414 coupled to a needled tip section 416 via a connector 418, which may comprise an externally threaded member or any other suitable fastening device. The needle body section 414 may be formed from stainless steel, aluminum, or any other suitable material, while the needle tip section 416 may be formed from plastic, metal, ceramic, Delrin, or any other suitable material. Moreover, the needle tip section 416 may be replaced with a different needle tip section to accommodate a different configuration of the fluid delivery tip assembly 204 or to refurbish the needle valve 234 after significant wear. It also should be noted that the needle valve 234 illustrated by FIG. 14 may be used with any configuration of the fluid breakup section 266 and the fluid mixing section 268. Accordingly, the illustrated fluid breakup section 266 may comprise any one or both of the diverging or converging passage sections 292 and 294 or any other suitable fluid mixing and breakup configuration. Again the impingement angles in the fluid breakup section 266 may be selected to accommodate a particular coating fluid and spray application.

Figure 15:
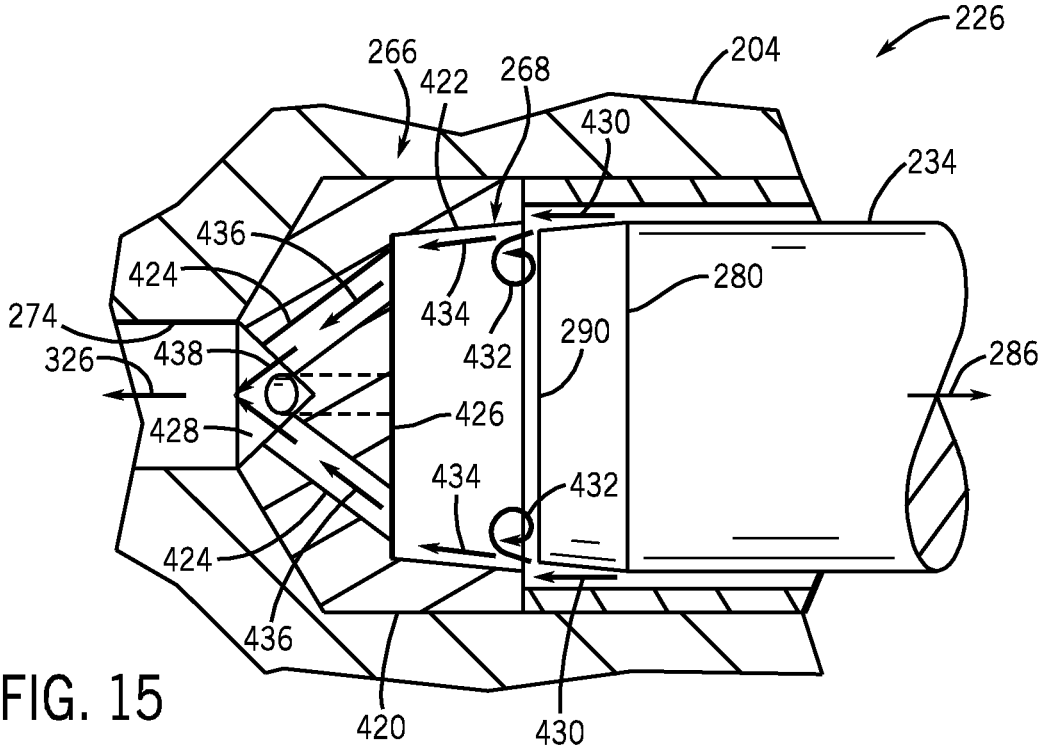
FIG. 15 is a partial cross-sectional side view of a further alternative embodiment of the fluid delivery tip assembly of FIG. 4 having an alternative converging passage section and blunt-tipped fluid valve.

FIG. 15 is a cross-sectional side view of the fluid delivery tip assembly 204 illustrating an alternative embodiment of the needle valve 234 and the fluid breakup and mixing sections 266 and 268. As illustrated, the fluid breakup section 266 comprises a converging passage section 420, while the fluid mixing section 268 has a wedge shaped mixing cavity 422 between the converging passage section 420 and the needle valve 234. The converging passage section 420 has passages 424 extending convergingly from a vertical flow barrier 426 in the wedge shaped mixing cavity 422 toward a fluid impingement region 428 adjacent the fluid tip exit passage 274. The needle valve 234 controls the fluid flow through the fluid delivery tip assembly 204 by moving the needle tip 280 inwardly and outwardly from the wedge shaped mixing cavity 422.

In operation, fluid flows around the needle tip 280, mixingly past the blunt edge 290, through the wedge shaped mixing cavity 422 and against the vertical flow barrier 426, through the passages 424, and convergingly inward toward one another in the fluid impingement region 428, and out through the fluid tip exit passage 274, as indicated by arrows 430, 432, 434, 436, 438, and 326, respectively. The blunt edge 290 facilitates fluid mixing past the needle tip 280 by inducing swirling/mixing based on the velocity differential. Mixing is further induced by the vertical flow barrier 426 and wedge shaped mixing cavity 422, which substantially block the fluid flow and induce fluid mixing between the vertical flow barrier 426 and the blunt edge 290. The converging passage section 420 further mixes and breaks up the fluid flow by restricting the fluid flow into the passages 424, thereby increasing the fluid velocity and forcing the fluid to eject as fluid jets that impinge one another in the fluid impingement region 428. The impingement of the fluid jets in the fluid impingement region 428 then forces the particulate/ligaments within the fluid to breakup into finer particulate prior to atomization by the spray formation assembly 208. Again, the present technique may select any suitable impingement angle within the scope of the present technique.

Figure 16:
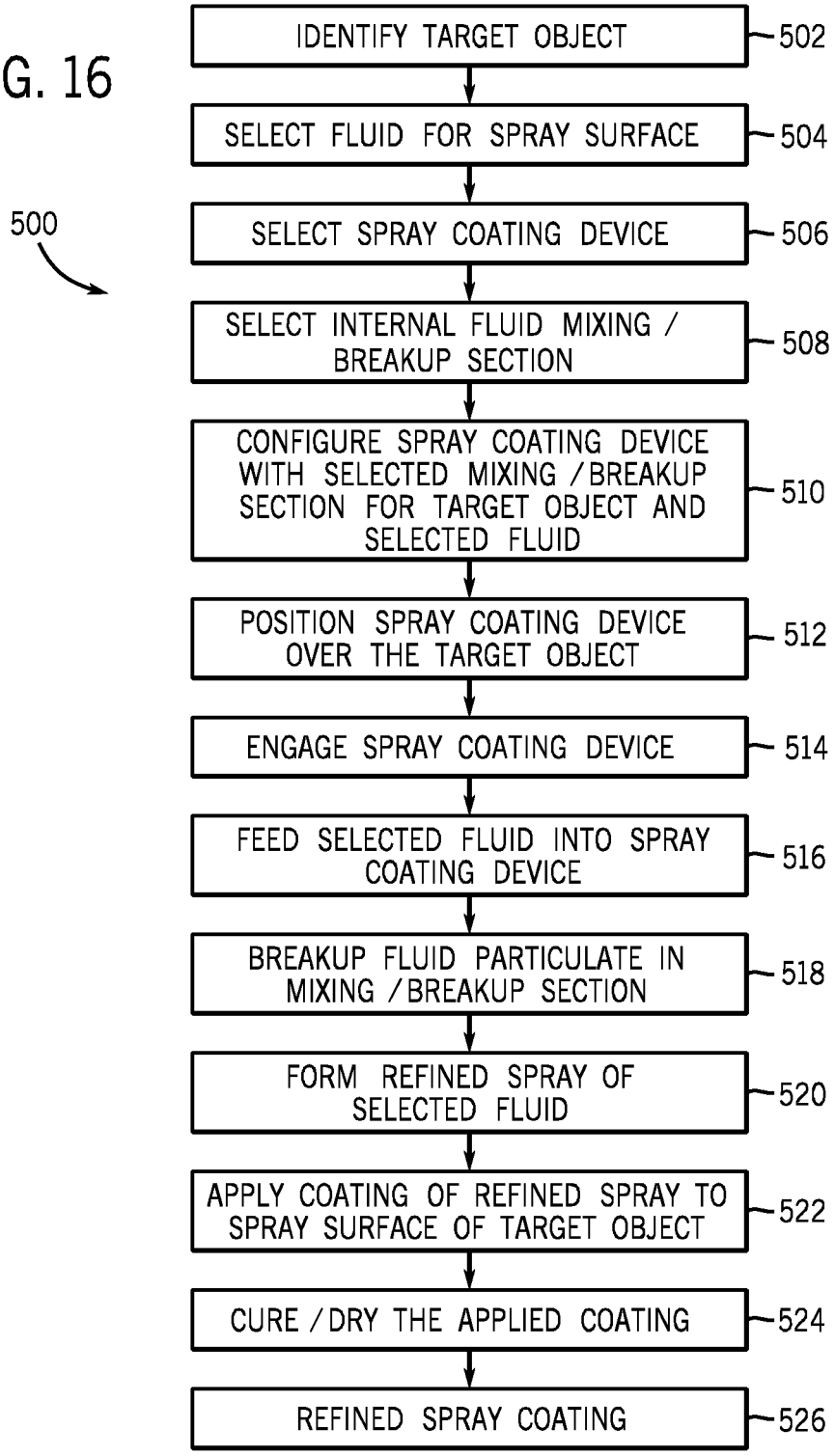
FIG. 16 is a flow chart illustrating an exemplary spray coating process using the spray coating device illustrated in FIGS. 3-15.

FIG. 16 is a flow chart illustrating an exemplary spray coating process 500. As illustrated, the process 500 proceeds by identifying a target object for application of a spray coating (block 502). For example, the target object may comprise a variety of materials and products, such as wood or metal furniture, cabinets, automobiles, consumer products, etc. The process 500 then proceeds to select a desired fluid for coating a spray surface on the target object (block 504). For example, the desired fluid may comprise a primer, a paint, a stain, or a variety of other fluids suitable for a wood, a metal, or any other material of the target object. The process then proceeds to select a spray coating device to apply the desired fluid to the target object (block 506). For example, a particular type and configuration of a spray coating device may be more effective at applying a spray coating of the desired fluid onto the target object. The spray coating device may be a rotary atomizer, an electrostatic atomizer, an air jet atomizer, or any other suitable atomizing device. The process 500 then proceeds to select an internal fluid mixing/breakup section to facilitate breakup of particulate/ligaments (block 508). For example, the process 500 may select any one or a combination of the valve assemblies, diverging passage sections, converging passage sections, and fluid mixing sections discussed with reference to FIGS. 3-15. The process 500 then proceeds to configure the spray coating device with the selected one or more mixing/breakup sections for the target object and selected fluid (block 510). For example, the selected mixing/breakup sections may be disposed within an air atomization type spray coating device or any other suitable spray coating device.

After the process 500 is setup for operation, the process 500 proceeds to position the spray coating device over the target object (block 512). The process 500 also may utilize a positioning system to facilitate movement of the spray coating device relative to the target object, as discussed above with reference to FIG. 1. The process 500 then proceeds to engage the spray coating device (514). For example, a user may pull a trigger 244 or the control system 20 may automatically engage the spray coating device. As the spray coating device is engaged at block 514, the process 500 feeds the selected fluid into the spray coating device at block 516 and breaks up the fluid particulate in the mixing/breakup section at block 518. Accordingly, the process 500 refines the selected fluid within the spray coating device prior to the actual spray formation. At block 520, the process 500 creates a refined spray having reduced particulate/ligaments. The process 500 then proceeds to apply a coating of the refined spray to the spray surface of the target object (block 522). At block 524, the process cures/dries the applied coating to the spray surface of the target object. Accordingly, the spray coating process 500 produces a refined spray coating at block 526. The refined spray coating may be characterized by a refined and relatively uniform texture and color distribution, a reduced mottling effect, and various other refined characteristics within the spray coating.

Figure 17:
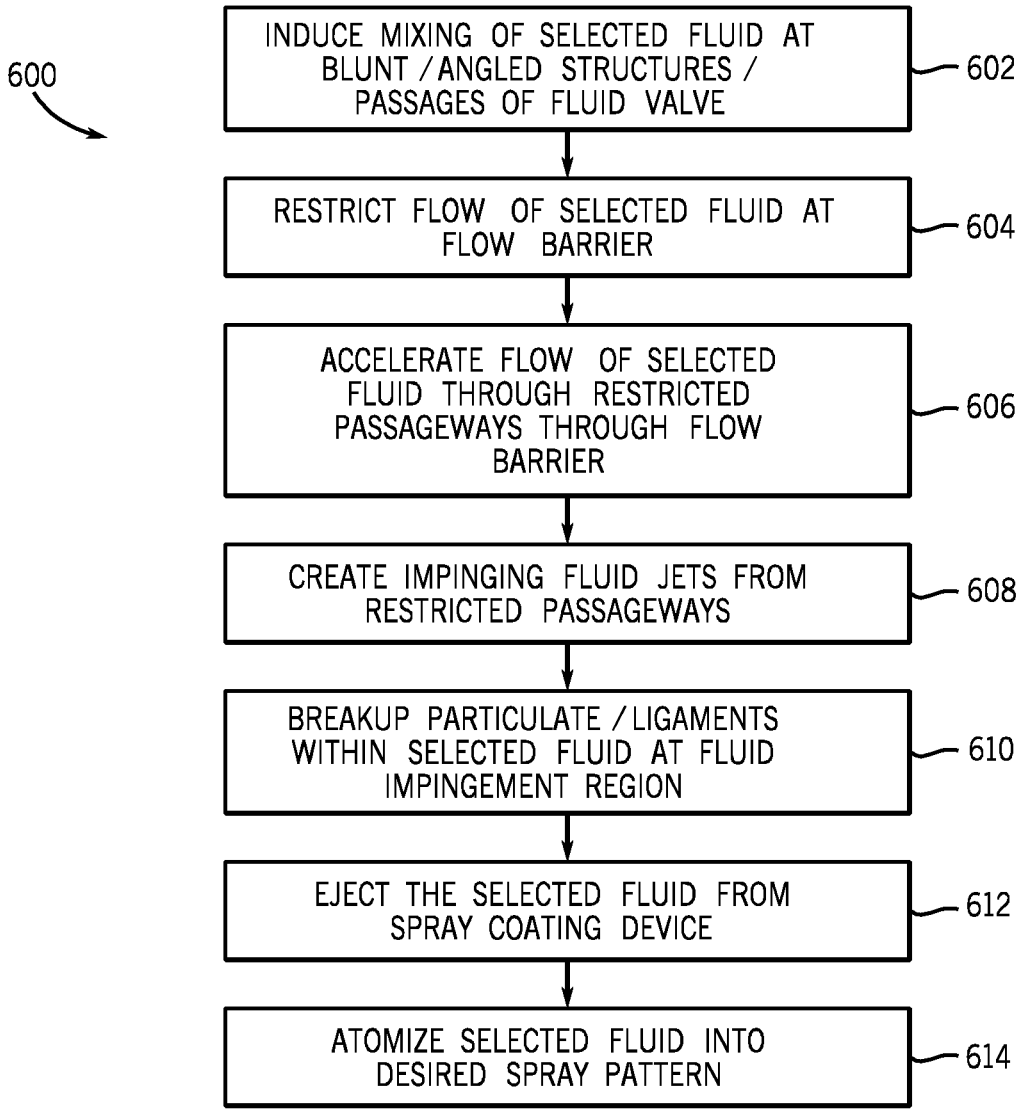
FIG. 17 is a flow chart illustrating an exemplary fluid breakup and spray formation process of the present technique using the spray coating device illustrated in FIGS. 3-15.

FIG. 17 is a flow chart illustrating an exemplary fluid breakup and spray formation process 600. The process 600 proceeds by inducing mixing of a selected fluid at one or more blunt/angled structures and/or passages of a fluid valve (block 602). For example, the process 600 may pass the selected fluid through or about any one of the needle valves 234 described above with reference to FIGS. 3-15. Any other suitable hollow or solid fluid valves having blunt/angled structures/passages also may be used within the scope of the present technique. The process 600 then proceeds to restrict the fluid flow of the selected fluid at a flow barrier (block 604). For example, a vertical or angled surface may be extended partially or entirely across a flow passageway through the spray coating device. The process 600 then proceeds to accelerate the fluid flow of the selected fluid through restricted passageways extending through the flow barrier (block 606). At block 608, the process creates one or more impinging fluid jets from the restricted passageways. The process 600 then proceeds to breakup particulate/ligaments within the selected fluid at a fluid impingement region downstream of the impinging fluid jets (block 610). For example, the one or more impinging fluid jets may be directed toward one another or toward one or more surfaces at an angle selected to facilitate the breakup of particulate/ligaments. After the process 600 has mixed and broken up the particulate/ligaments within the selected fluid, the selected fluid is ejected from the spray coating device at block 612. The process 600 then proceeds to atomize the selected fluid into a desired spray pattern from the spray coating device (block 614). The process 600 may use any suitable spray formation mechanism to atomize the selected fluid, including rotary atomization mechanisms, air jet atomization mechanisms, electrostatic mechanisms, and various other suitable spray formation techniques.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A system, comprising:

a spray gun, comprising:

a body having a handle;

an air inlet extending from the handle;

a trigger coupled to the body by a pivot joint, wherein a distal end of the trigger is disposed in front of the handle;

a liquid inlet extending from the body and disposed in front of the trigger;

a needle valve coupled to the trigger and having a generally frusto-conical abutment surface, wherein the needle valve is configured to translate in response to movement of the trigger;

a spray tip assembly, comprising:

a fluid delivery tip section comprising a passage that receives a tip of the needle valve, wherein the passage is configured to seal with the generally frusto-conical abutment surface of the needle valve, and the passage is downstream from the liquid inlet;

a fluid breakup section disposed within the fluid delivery tip section downstream from the passage, wherein the fluid breakup section comprises a plurality of internal passages tunneling directly from respective inlets disposed on a first side to respective outlets disposed on a second side of the fluid breakup section, the plurality of internal passages generally converge toward one another at a first angle and generally twist at a second angle, and the plurality of internal passages are configured to impart a swirling motion to a liquid flow;

a region downstream from the plurality of internal passages and configured to receive swirling liquid from the plurality of passages;

a liquid exit downstream from the region; and an air atomization cap having a plurality of air atomization orifices in fluid communication with the air inlet, wherein at least part of the air atomization cap is disposed downstream from the liquid exit.

2. The system of claim 1, wherein the first angle is in the range of 25 to 45 degrees.

3. The system of claim 1, wherein the plurality of internal passages comprises four internal passages.

4. The system of claim 1, wherein each passage among the plurality of internal passages has a generally circular cross-section completely surrounded by the fluid breakup section between the respective inlets and the respective outlets.

5. The system of claim 1, wherein each passage among the plurality of internal passages is non-parallel relative to an outer surface of the fluid breakup section.

6. The system of claim 1, comprising a fluid supply configured to couple to the liquid inlet and supply a coating liquid.

7. The system of claim 1, comprising an air supply configured to couple to the air inlet and supply air to the air inlet.

8. An apparatus, comprising:

a spray gun assembly comprising:

a fluid delivery section comprising a central passage;

a fluid breakup section disposed within the fluid delivery section, wherein the fluid breakup section comprises a plurality of converging internal passages disposed downstream from the central passage, the plurality of converging internal passages are configured to converge toward one another and to impart a swirling motion on a liquid flowing through the plurality of converging internal passages, and the fluid breakup section completely surrounds the plurality of converging internal passages between upstream and downstream ports of the plurality of converging internal passages;

a chamber disposed downstream of the plurality of converging internal passages; and a fluid exit disposed downstream of the chamber.

9. The apparatus of claim 8, wherein the plurality of converging internal passages is offset completely away from an interior surface of the central passage.

10. The apparatus of claim 8, wherein the plurality of converging internal passages comprises four converging internal passages tunneling through the fluid breakup section offset completely away from an outer surface of the fluid breakup section.

11. The apparatus of claim 8, wherein the plurality of converging internal passages generally converge at a first angle toward, but offset from, a central axis.

12. The apparatus of claim 8, wherein each passage among the plurality of converging internal passages is non-parallel relative to an outer surface of the fluid breakup section.

13. The apparatus of claim 8, wherein the chamber is disposed immediately downstream from the plurality of converging internal passages.

14. The apparatus of claim 8, wherein the chamber comprises a converging section and the fluid exit comprises a constant-width section.

15. An apparatus, comprising:

a spray gun assembly comprising:

a central passage having a central axis;

a liquid inlet disposed upstream from the central passage;

a liquid outlet disposed downstream from the central passage;

a one-piece insert disposed in the central passage between the liquid inlet and the liquid outlet, wherein the one-piece insert comprises a plurality of tubular passages tunneling directly through an interior of the one-piece insert, the tubular passages have axes that converge toward the central axis in a downstream direction, and the axes of the tubular passages are oriented at an offset from the central axis to induce swirl in the downstream direction;

a mixing chamber in the central passage between the one-piece insert and the liquid outlet, wherein the mixing chamber extends across the central axis of the central passage.

16. The apparatus of claim 15, wherein the one-piece insert comprises a cylindrical structure having a cylindrical exterior surface that completely encloses the plurality of tubular passages except for upstream and downstream ports.

17. The apparatus of claim 16, wherein the plurality of tubular passages comprises a plurality of cylindrical passages that converge toward the central axis and induce swirl.

18. The apparatus of claim 16, wherein the cylindrical exterior surface of the one-piece insert mates against a cylindrical interior surface of the central passage at an annular interface to block liquid flow along the annular interface.

19. The apparatus of claim 15, comprising an air passage leading to an air outlet, wherein the air outlet is directed toward a liquid path exiting from the liquid outlet.

20. An apparatus, comprising:

a spray gun assembly comprising:

a liquid passage;

a one-piece insert disposed in the liquid passage, wherein the one-piece insert comprises a plurality of passages closed within an exterior surface of the one-piece insert, and the plurality of passages have axes that converge toward one another and swirl about a common axis;

a mixing chamber in the liquid passage directly downstream from the one-piece insert; and a liquid outlet downstream from the mixing chamber; and an air passage leading to an air outlet, wherein the air outlet is directed toward a liquid path exiting from the liquid outlet.

21. The apparatus of claim 20, wherein the one-piece insert comprises a cylindrical structure having a cylindrical exterior surface that encloses the plurality of passages.

22. The apparatus of claim 21, wherein the plurality of passages comprises a plurality of cylindrical passages that converge toward one another and swirl about the common axis.

23. The apparatus of claim 21, wherein the cylindrical exterior surface of the one-piece insert mates against a cylindrical interior surface of the liquid passage at an annular interface to block liquid flow along the annular interface.

24. The apparatus of claim 20, wherein the air outlet comprises a ring-shaped air outlet coaxial with the liquid outlet, an air shaping port angled inwardly toward a liquid path from the liquid outlet, or a combination thereof.

25. The apparatus of claim 20, wherein each passage among the plurality of passages is non-parallel relative to the exterior surface.

* * * * *